US007222856B2

(12) United States Patent
Dodge

(10) Patent No.: US 7,222,856 B2
(45) Date of Patent: May 29, 2007

(54) METHOD FOR PLAYING POKER WITH ADDITIONAL CARD DRAWS

(75) Inventor: Clifford B. Dodge, Billings, MT (US)

(73) Assignee: Summit Amusement and Distributing, Ltd., Billings, MT (US)

( * ) Notice: Subject to any disclaimer, the term of this patent is extended or adjusted under 35 U.S.C. 154(b) by 264 days.

(21) Appl. No.: 10/999,041

(22) Filed: Nov. 29, 2004

(65) Prior Publication Data

US 2006/0113729 A1 Jun. 1, 2006

(51) Int. Cl.
*A63F 1/00* (2006.01)

(52) U.S. Cl. ..... 273/292; 463/13

(58) Field of Classification Search ..... 273/274, 273/292; 463/13
See application file for complete search history.

(56) References Cited

U.S. PATENT DOCUMENTS 5,308,065 A * 5/1994 Bridgeman et al. ..... 463/13
5,332,219 A * 7/1994 Marnell et al. ..... 463/13
5,591,081 A * 1/1997 Suzuki ..... 463/13
5,947,831 A * 9/1999 McCarthy ..... 473/197
6,110,040 A * 8/2000 Sanduski et al. ..... 463/13
6,299,170 B1 * 10/2001 Yoseloff ..... 273/292
7,022,016 B2 * 4/2006 Wood et al. ..... 463/13
7,056,206 B2 * 6/2006 Aoki et al. ..... 463/13

* cited by examiner

*Primary Examiner*—William M. Pierce
(74) *Attorney, Agent, or Firm*—Joseph E. Funk

(57) ABSTRACT

An improved poker game is disclosed that provides a player with an initial five card poker hand plus an indication of additional nudge cards. Four cards in a deck having the same face value, but not suit, are the nudge cards. For each nudge card that a player is initially dealt or receives thereafter during the course of game play the player receives an option to replace a card in their hand. The nudge cards may also be single cards or wild cards.

21 Claims, 14 Drawing Sheets

PAY TABLE

| | BET 1 | BET 2 | BET 3 | BET 4 | BET 5 | BET 6 | BET 7 |
|---|---|---|---|---|---|---|---|
| Royal Flush | 750 | 1500 | 2250 | 3000 | 3200 | 3200 | 3200 |
| Straight Flush | 100 | 200 | 300 | 400 | 500 | 600 | 700 |
| 4 Of A Kind | 25 | 50 | 75 | 100 | 125 | 150 | 175 |
| Full House | 7 | 14 | 21 | 28 | 35 | 42 | 49 |
| Flush | 5 | 10 | 15 | 20 | 25 | 30 | 35 |
| Straight | 4 | 8 | 12 | 16 | 20 | 24 | 28 |
| 3 Of A Kind | 3 | 6 | 9 | 12 | 15 | 18 | 21 |
| Two Pair | 2 | 4 | 6 | 8 | 10 | 12 | 14 |
| Jacks Or Better | 1 | 2 | 3 | 4 | 5 | 6 | 7 |

*Figure 13*

METHOD FOR PLAYING POKER WITH ADDITIONAL CARD DRAWS

FIELD OF THE INVENTION

The invention relates primarily to electronic video poker games, and more particularly to electronic video poker games.

BACKGROUND OF THE INVENTION

Wagering games are more successful, wherever they are played, when players are provided with a sense of participation and control, the opportunity to make decisions, reasonable odds of winning, and what the players perceive is an improved chance to beat the odds that are normally in favor of a casino.

Poker, in its many variations, is well known and is played using a standard deck of playing cards, and no standard poker hand contains more than five cards. In poker, various combinations of five cards from a standard fifty-two card deck have significance based on both the numerical or face value of the cards and their suits. The basic object of poker is for a player to achieve a five card hand having a higher poker rank than the hands held by the player's opponents. Even when wild cards are used, they only substitute for cards in the defined combinations and do not create new or broader combinations of winning poker hands, although they improve the odds of having a winning hand.

Poker is played in a number of variations including draw poker and stud poker. Probably the most common and popular poker variation is draw poker in which the player has the opportunity to substitute one or more of the cards they are initially dealt in an effort to improve the value of their hand.

The introduction of computerized, video poker games permits players to see the representation of dealt hands on a video screen, and the players usually play against a standard payout table retained in the computer's memory. For one example, conventional video draw poker is a single player game in which a player does not play against a dealer or other players, but rather tries to achieve the highest possible ranking poker hand. A payout schedule is used to determine the amount awarded to the player for achieving specified winning combinations of cards. After an initial deal of five cards, the player is allowed to discard unwanted cards and draw replacement cards. Poker hand rankings are used to determine winning card combinations and a payout schedule is used to determine the amount awarded to the player for achieving various winning card combinations. The number of winning card combinations possible in a five card draw poker game means that, even at the lower payout value levels, a player has a relatively low probability of having a winning hand, even though lower ranked winning hands of cards are the ones which occur most frequently.

The conventional poker hand rankings that are used in video draw poker in order from highest to lowest are: royal flush, straight flush, four of a kind, full house, flush, straight, three of a kind, two pair and a pair of jacks or better. Any hand having less than a pair of jacks or better is a losing hand. There is a wide difference in the winnings between a royal flush and a pair of jacks or better.

Over time gaming casino patrons become bored with standard versions of poker games and the casinos are continually looking for new variations of video poker games to continually create renewed interest and attract more players to play video poker.

It would therefore be advantageous to have new poker games which are similar to conventional poker games in their playing strategy but which provide for greater player interaction with the game, and which would appear to provide greater opportunities for winning. Such new games would stimulate renewed interest of experienced players, and the interest of casual players, who will both find the games exciting.

SUMMARY OF THE INVENTION

The present invention combines the most desirable elements of conventional poker games with a novel improvement that gives a player more sense of participation and control, the opportunity to make decisions, reasonable odds of winning, and what the players perceive is a chance to beat odds that are normally in favor of a casino.

With respect to one poker game, draw poker, the improvement is achieved by dealing a player an initial five card draw poker hand plus identifying an additional card called a nudge card. All four cards in the deck of cards having the same face/numerical value as the identified nudge card are nudge cards. Each nudge card that is in a player's hand after they have held and redrawn cards provides the player with an option to replace one card in their hand. Nudge cards may also be obtained as a result of exercising a nudge option and replacing a card. The ability to draw additional cards for use in developing a winning hand gives the player the sense that they have a better chance of winning the poker game, although the changed odds are accounted for in the pay table for the game. In other types of poker games the nudge cards are used to provide players with the ability to discard and draw additional cards after an initial discard and draw of cards as is conventionally provided with such games.

DESCRIPTION OF THE DRAWINGS

The invention will be better understood upon reading the following Detailed Description in conjunction with the drawing in which:

FIG. 13 shows a pay table indicating winnings for different winning hands of cards playing Nudge Poker;

DETAILED DESCRIPTION

Figure 1:
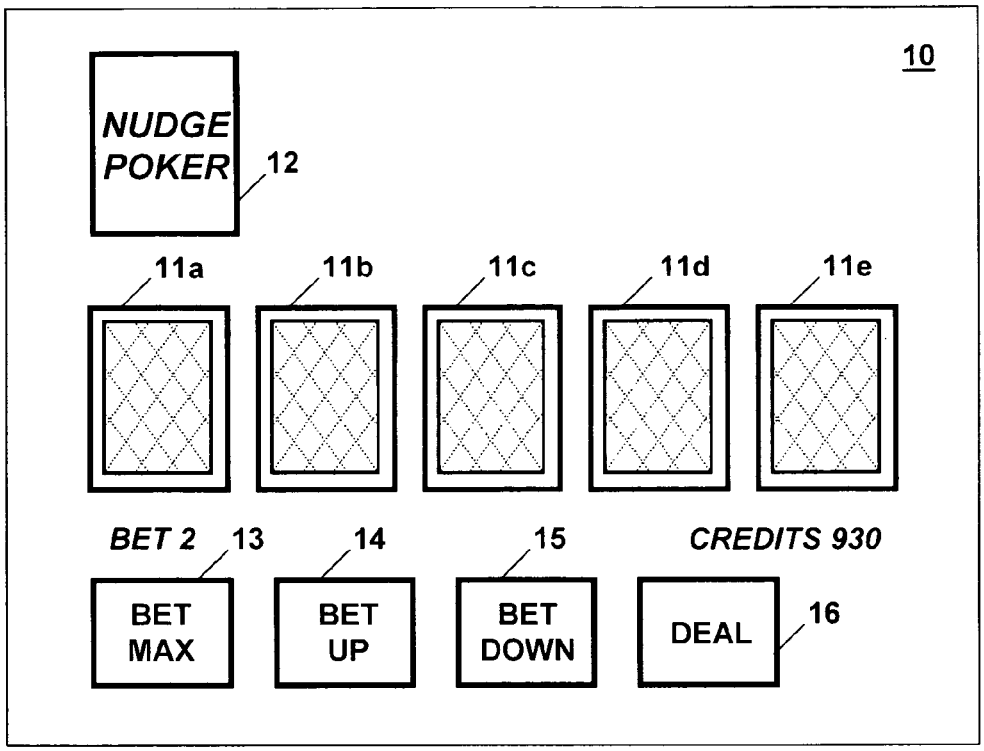
FIG. 1 shows a video display screen used for game play before the start of play of draw poker incorporating the invention and called "Nudge Poker"

The present invention combines the most desirable features of existing poker games with a novel improvement that gives a player more sense of participation and control, the opportunity to make decisions, reasonable odds of winning, and what the players perceive is a chance to beat odds that are normally in favor of a casino. The result is a class of more desirable poker games called Nudge Poker.

The improvement is achieved by initially dealing a player a poker hand plus identifying an additional card called a nudge card. In a first embodiment of the invention all four cards in the deck of cards having the same face/numerical value as the identified nudge card are nudge cards. Each nudge card that is in a player's hand after they have held and redrawn cards provides the player with an option to replace a card in their hand. Nudge cards may also be obtained as a result of exercising a nudge option and replacing a card. The ability to draw additional cards for use in developing a winning hand gives the player the sense that they have a better chance of winning the poker game, although the changed odds are reflected in the pay table for the game. It is the first embodiment of the invention used with draw poker and called "Nudge Poker" that is first described in detail in the following detailed description of the invention with reference to FIGS. 2–15.

In a second embodiment of the invention as shown in and described with reference to FIGS. 16–18 only a single card having a defined face value and a defined suit is randomly designated to be a nudge card.

In a third embodiment of the invention as shown in and described with reference to FIGS. 19–22 more than one card is randomly selected from a standard deck of cards to be nudge cards.

In a fourth embodiment of the invention as shown in and described with reference to FIGS. 23 and 24 a nudge card is randomly selected at the beginning of game play as previously described but only cards that are marked as nudge cards will be replaced. In one example an arrow is displayed both above and below a dealt nudge card in an initially dealt hand and a player selects a card to replace the nudge card by touching the arrow above or below the nudge card. When the arrow above the nudge card is touched the card in the deck of cards that was immediately above the nudge card is picked to replace the nudge card, and when the arrow below the nudge card is touched the card in the deck of cards that was immediately below the nudge card is picked to replace the nudge card.

In yet another embodiment of the invention, not disclosed in detail herein, one or more additional cards, such as jokers but not limited thereto, is added to a standard deck of cards and is designated nudge cards. If the nudge cards are jokers, they may also be wild cards at the same time.

Many other embodiments of the invention are also contemplated. For example, the nudge feature may be implemented in various forms of game play. In one of these other embodiments the nudge feature may not be implemented in every game played, but may be accumulated over several game plays of poker. For example, the player may play ten games of poker. In each of these ten games nudge cards are identified in the manner such as described hereinafter for draw poker in the form called "Nudge Poker". At the end of the ten games the player is given the opportunity to use any nudges accumulated over the ten games during a bonus poker game. After using available nudges the player nudge count starts back at zero, play resumes as normal, and the counting cycle starts again. This encourages a player to play man, games of poker. In yet another embodiment of the invention, prior to the commencement of game play a player may select a card, say sevens, to be the nudge card value for the game.

In FIGS. 1–12 and 16–24 are shown a video display screen 10 of a gaming machine (details not shown) used to play the embodiment of the invention described herein based on draw poker and called Nudge Poker which is draw poker having a novel nudge function to replace additional cards. A typical gaming machine has other elements, not shown in these Figures because they are well known in the art, that are deleted to simplify and not obscure the presentation of the invention. Such other typical elements include a game housing having a front panel with the video display screen 10; coin, token, paper money, and/or debit card slots; a flashing light on the top of the housing to announce a winning jackpot; and other controls. Also included on the front panel of the game housing are game instructions to instruct a player as to how to play the Nudge Poker game and preferably instructions on the video display screen 10 indicating what action is required by the player at particular times during game play. These other elements form no specific part of the present invention.

Video display screen 10 and its associated electronics are equipped to provide touch screen operation. The use of touch screen technology with gaming machines is well known in the video gaming art. As specific locations on screen 10 are touched during game play the touch is sensed by a computer and appropriate game action is taken as is described hereinafter.

It will be assumed throughout the remainder of this Detailed Description that a player is utilizing and has inserted a debit card (not shown) into an appropriate slot (not shown) in the front panel of the gaming machine. The debit card has stored thereon a numerical indication of a number of credits which the player may use to bet and play games. Bets are debited from the stored amount, and winnings are added to the stored amount. When a player first inserts their debit card into the appropriate slot in the front panel of a gaming machine the number of credits currently held by the player are read from the debit card and are displayed on video display screen 10 as shown in FIG. 1. The number of credits increases and decreases during the course of playing games as a player places bets, wins and loses.

Figure 10:
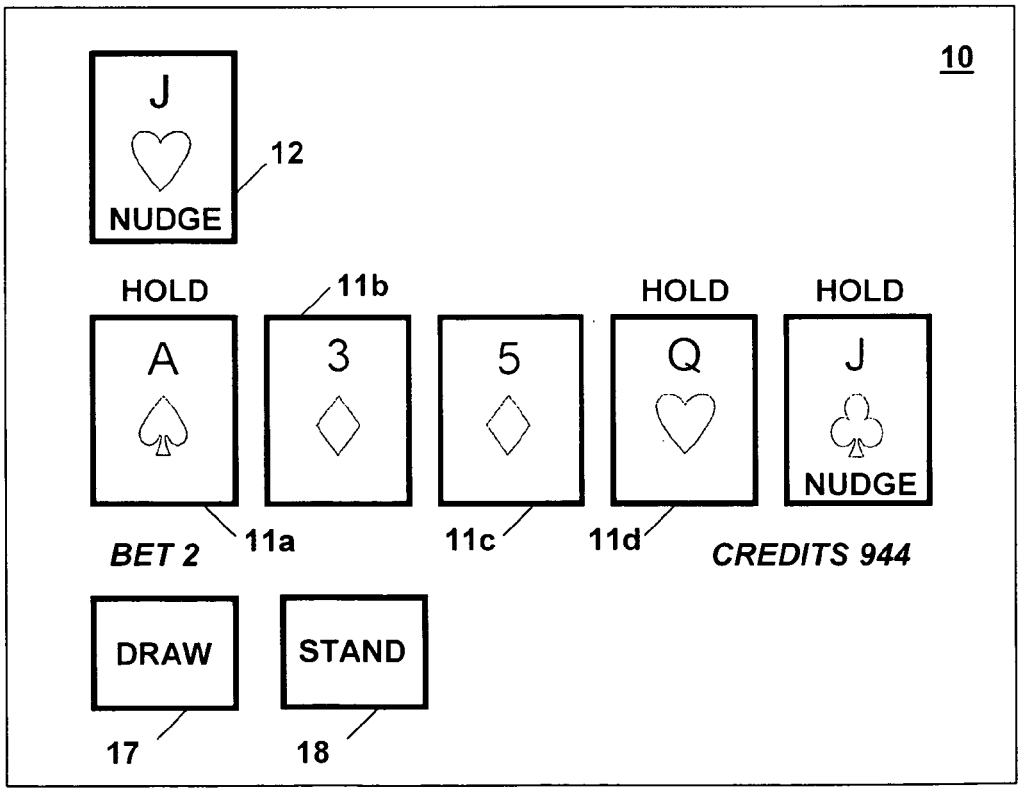
FIG. 10 shows an initial hand of cards, including a nudge card, dealt to a player during a third example of play of Nudge poker, the cards held by the player, and the designation of a nudge card.
Figure 11:
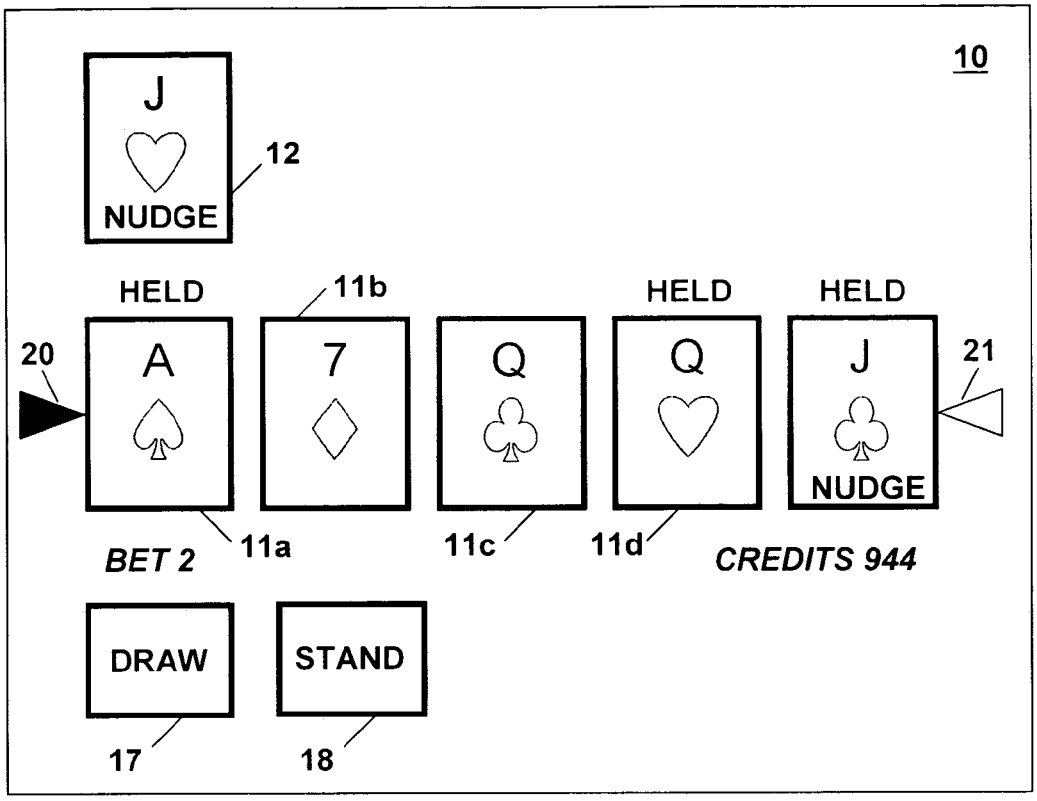
FIG. 11 shows the replacement of non-held cards during a third example of play where the player holds a nudge card from the initially dealt hand, and the preparation for exercising a nudge option to improve the player's hand of cards by replacing a card in the players hand.
Figure 12:
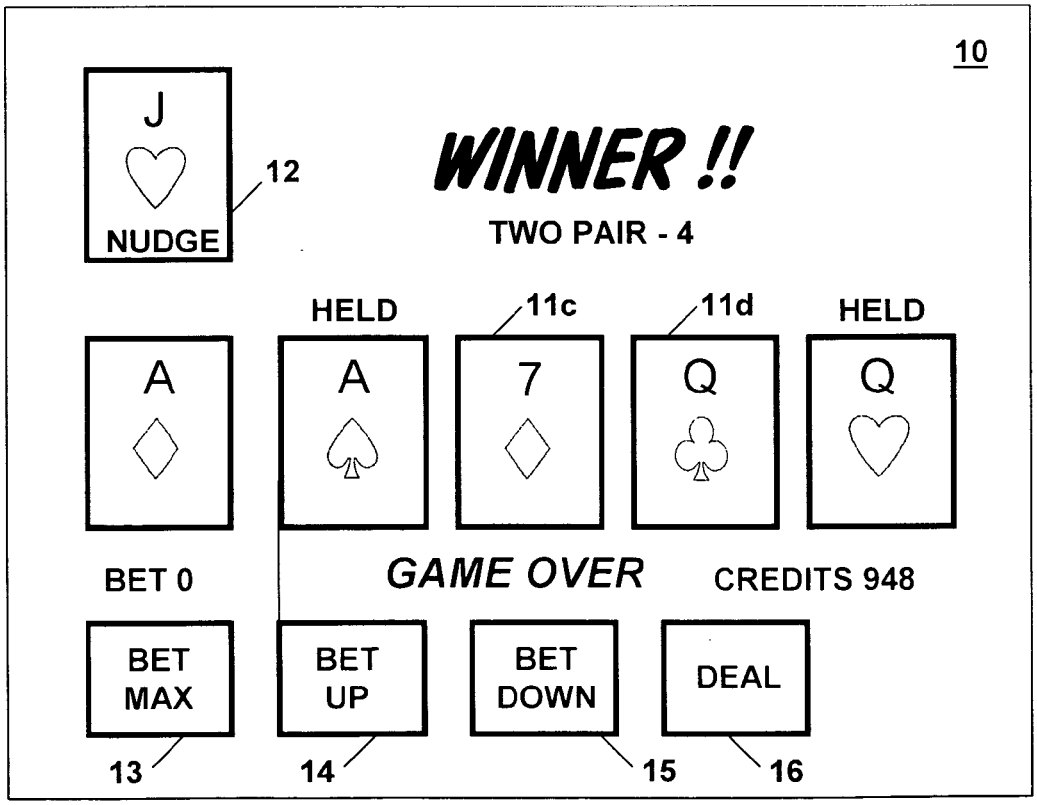
FIG. 12 shows the replacement of a card in the player's hand after exercise of the nudge option, and an indication that the final hand of five cards is a winning hand for the third example of play of Nudge Poker.

Three examples of a first embodiment of game play of the novel Nudge Poker draw poker game are shown in and described with reference to FIGS. 2–12, and a logic flow chart for the game is shown in and described with reference to FIGS. 14 and 15 reflects the logic of game play of Nudge Poker for the three examples of game play. Very briefly, FIGS. 2–5 show the first example of game play of the novel "Nudge Poker" game in which the player has two pairs after holding and redrawing cards, including two nudge cards, but after exercising the two nudge options and replacing two cards in their hand the player holds a full house. FIGS. 6–9 show the second example of play of the novel "Nudge Poker" game in which the player isn't dealt any nudge cards in their initial hand, but receives a nudge card and a first nudge option after holding and redrawing cards. After exercising the first nudge option the player receives a second nudge card and a second nudge option is exercised. The player's card hand has improved from jacks or better to three of a kind after exercising the second nudge option. FIGS. 10–12 show the third example of play of the novel "Nudge Poker" game in which the player receives a nudge card in the initially dealt hand. After holding and redrawing cards the player has jacks or better, but after exercising the nudge option the player has two pair.

In FIG. 1 is shown a video display screen 10 as it appears before the start of game play of the novel Nudge Poker game. There are five positions 11*a*–11*e* in which an initial hand of five cards will be dealt when game play commences. Initially, the back side of the playing cards is displayed in each of positions 11*a*–11*e*. There is a position 12 in which is displayed the name Nudge Poker before game play is commenced. Position 12 is utilized to display the nudge card for each round of game play.

Figure 2:
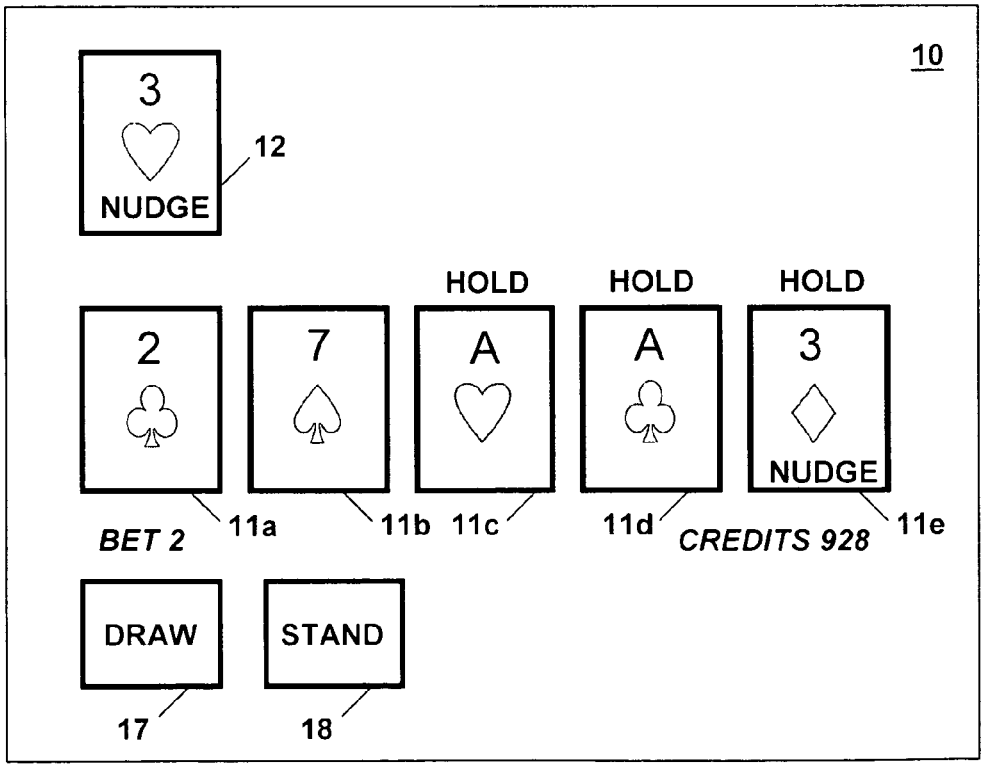
FIG. 2 shows an initial five card hand dealt to a player during a first example of play of Nudge Poker, the cards held by the player, and the designation of a "nudge" card.

There are various touch screen buttons shown on video display screen 10 that are used in many gambling games, such as Max Bet 13, Bet Up 14, Bet Down 15 and Deal 16. During the course of game play, buttons 13 through 16 in FIG. 1 cease to be displayed and, in their place, Draw button 17 and Stand button 18 are displayed and used as is described hereinafter with reference to FIG. 3. By limiting the number of buttons and indicators displayed on screen to only those needed during each stage of game play a player is less likely to become confused and is guided through game play. In addition, Nudge or Stand? indicator 19 is utilized in FIG. 3 that blinks to indicate to a player when and what choice they have to make, rather than blinking buttons 17 and 18 and leaving a player unsure as to what course of game play action they are to take. Also displayed on video display screen 10 are the number of bets wagered by a player on a game, and the balance of the number of credits indicated on the players debit card. In FIG. 1 the player starts with "930" credits and, after placing two bets on the first example of the game, the player has "928" credits remaining as shown in FIG. 2.

After a player inserts their debit card into an appropriate slot in the front panel of the gaming machine (both not shown) to indicate that they wish to play the Nudge Poker game, the number of credits the player has, as indicated by the number of credits stored on the player's debit card, is read from the card and displayed as described in the previous paragraph.

More particularly, a player physically touches ones of the displayed Bet buttons 13 through 15 on video screen 10 to place one or more bets on the game, up to a maximum of seven bets. Although not shown in FIG. 1, initially the number of bets is displayed as "Bet 0" since the player has not yet placed any bets. Each time the player touches a Bet button 13 through 15 it is sensed by the touch screen technology and the number of Bets displayed on video display 10 is changed accordingly. If the player changes their mind they may touch Bet Down button 15 to decrease their number of bets by one for each time button 15 is touched. In the example of the invention described herein it is assumed that only a maximum of seven bets may be placed on any single game, although this number is arbitrary.

This matches information in the Play Table shown in FIG. 13 which is described further in this specification.

One bet is equal to one credit in the descriptions of the three examples of the invention here in. Initially, the player starts with "930" credits in FIG. 1. After placing two bets the number of remaining credits is decremented to "928" as shown in FIG. 2. A Bet of at least one credit must be placed in order for the game to continue.

After one or more bets have been placed Deal button 16 starts blinking indicating to the player that they must touch this button to deal an initial hand of five cards. Responsive thereto, video display 10 changes to that shown in FIG. 2. Five cards are randomly dealt into display positions 11*a*–11*e* as shown. At the same time the game name "Nudge Poker" disappears and a card is randomly chosen and displayed at position 12, but the card is not removed from game play and it can be displayed in any one of the five card display positions 11*a*–11*e* at any time during game play. The card displayed in position 12 is called a nudge card and the word "Nudge" is displayed on the card. The nudge card is at the heart of the present invention. The numerical or face value of the nudge card displayed in position 12, but not its suit, is used to identify the "nudge card" for a particular game of Nudge Poker being played. In the first game example shown in FIG. 2, the three of hearts is displayed in position 12 so three's become the nudge card value. There is a nudge card with the face value three displayed in display position 11*e* so the word "Nudge" is displayed with this card. The purpose of the nudge card is understood after reading the description of the following three game examples.

It should be noted that as video display 10 changes to that shown in FIG. 2 buttons 13 through 16 disappear from the screen and two new buttons are displayed. They are Draw button 17 and Stand button 18. These two buttons are not needed until this point in game play so they are not displayed until this time. By displaying buttons only as needed during game play a player is guided as to what buttons can be used at each stage of game play. After buttons are displayed they may be selectively blinked to guide a player to which button or buttons may be operated during each stage of game play.

In the three examples of the first embodiment of the invention now being described Stand button 18 is provided and functions in a manner well known in conventional poker games such as draw poker. However, its provision and use is optional and in yet other embodiments of the invention the Stand function can be deleted and a player may only select cards to beheld, replace non-selected cards and use nudge cards to replace yet other cards.

The player studies the initial hand of five cards dealt into display positions 11*a*–11*e* in FIG. 2 and makes a decision as to which of the cards are to be held and which of the cards are to be discarded and redrawn in a manner well known in the draw poker art.

In the first game example, of the initially dealt hand of cards displayed in FIG. 2 the player elects to hold the three of diamonds in position 11*e*, the ace of hearts in position 11*c* and the ace of clubs in position 11*d*. The player selects the cards to be held by physically touching the display positions 11*c*, 11*d* and 11*e* on video display 110. This action is sensed by the touch screen of the gaming system and the word "HOLD" is displayed adjacent to each of the three held cards. A player may change their mind at any time before either Draw button 17 or Stand button 18 is touched and again touch a display position to reverse their election as to a held card.

Alternatively, if the player is initially dealt a good hand of cards that they wish to keep they will touch Stand button 18. In that case the game progresses to FIG. 5 with the held hand of cards and game play is completed as described hereinafter with reference to that figure.

After held cards have been selected the player touches Draw button 17. Responsive thereto video display 10 changes to that shown in FIG. 3. The non-held two of clubs in 11*a* is discarded and the king of diamonds is randomly drawn to take its place, and the non-held seven of spades in position 11*b* is discarded and the three of spades is randomly drawn to take its place. At the same time two "nudge arrows" 20 and 21 appear on display 10 along with an indicator 19 entitled "Nudge or Stand?". The two nudge arrows 20 and 21 and indicator 19 only appear on display 10 if there is at least one nudge card in the card hand displayed in position 11*a*–11*e* of FIG. 3 after cards have been discarded and replacement cards drawn. In this first game example, there are two nudge cards in positions 11*b* and 11*e* after card discard and draw. The player thus has two nudge options that may be exercised to replace two cards in their hand. Indicator 19 blinks to indicate to the player they have a choice to make. They must either: (a) elect to ignore the nudge function if they are satisfied with their new hand and touch Stand button 18, or (b) touch one of the nudge button arrows 20 or 21 to reject and replace a first of a maximum of two cards in an attempt to improve their hand of cards.

If after drawing replacement cards, the player has a good hand that they wish to keep they may touch Stand button 18 instead of exercising their nudge options received by having nudge cards in positions 11*b* and 11*e*. If they touch Stand button 18 game play progresses to FIG. 5 and the held hand of cards is analyzed to determine the winnings for the hand. In draw poker a player is sometimes restricted to how many cards they may replace, and such a restriction may be applied to Nudge Poker. However, a player may also be allowed to hold no cards from their initial hand and if they do so and touch the Draw button 17 they will be dealt a new hand of five cards. In the three game examples described herein one or more cards are always being held and other cards replaced.

Only when there are nudge cards displayed in a player's hand after hold and redraw will the two nudge arrows 20 and 21 be displayed indicating that the nudge option is available to the player. If no nudge cards are shown in the hand after hold and redraw the nudge arrows are not displayed. Neither is indicator 19 displayed in that instance.

The player has the option to touch only one of the two nudge arrows 20 and 21. In accordance with the teaching of the invention, if the player touches left nudge arrow 20 all the cards in the hand shown in FIG. 3 will shift one position to the right and the three of diamonds in position 11*e* is lost and will be replaced. In its place a new card will appear in position 11*a*. Similarly, if the player touches right nudge arrow 21 all the cards in the hand shift one position to the left and the king of diamonds in position 11*a* is lost and will be replaced with a new card dealt into position 11*e*.

With the first game example the player touches nudge arrow 21, which is bolded to be black only for ease of presentation and to indicate that it is the chosen nudge arrow. All the cards in the hand shift one position to the left and the king of diamonds in position 11*a* is lost. In place of the king of diamonds the seven of hearts is randomly drawn and appears in position 11*e*. The player performs this nudge to hold the pairs of threes and aces. The resulting hand of cards is shown in FIG. 4.

Figure 3:
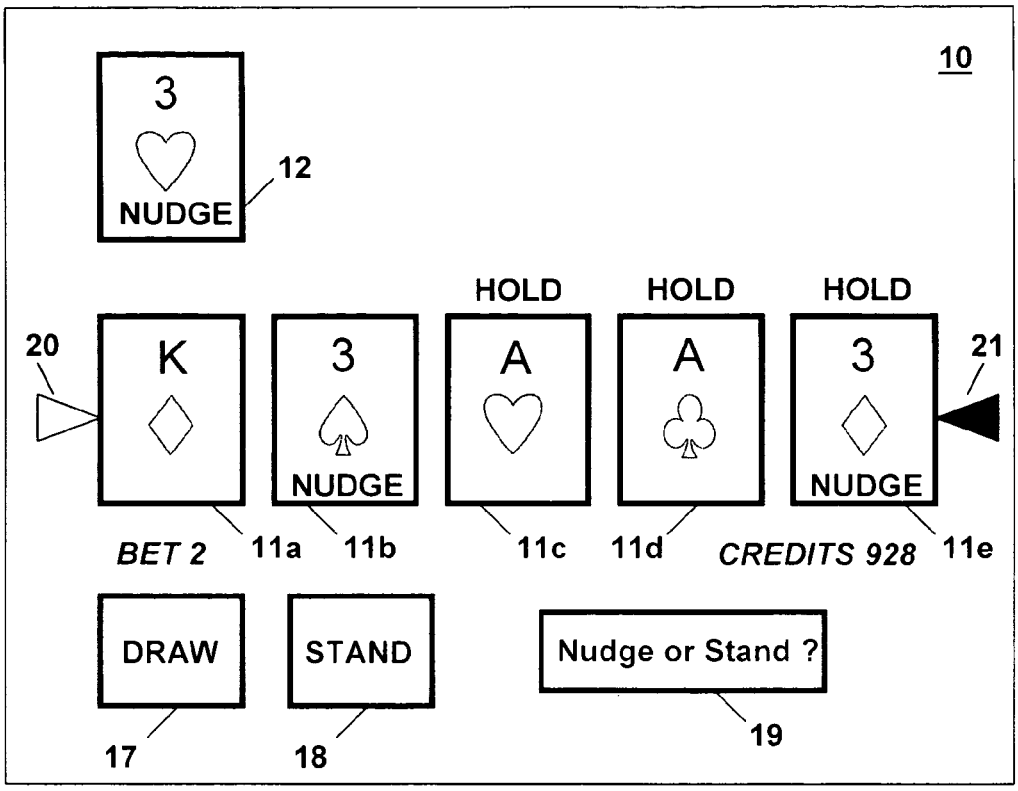
FIG. 3 shows the replacement of non-held cards for the first example of the invention and the preparation for exercising a nudge option and perform a first "nudge" step to improve the player's hand of cards by replacing a card in the player's hand after they have held and redrawn cards.

The player has two nudge cards, as shown in FIG. 3, so two nudge options are available. The player has exercised the first nudge option in FIG. 3 and has one nudge option remaining, so nudge arrows 20 and 21 are shown with the hand of cards in FIG. 4. After studying the hand of cards the player decides to nudge the cards to the right to hold the pairs of threes and aces. The final hand of five cards is shown in FIG. 5. In place of the seven of hearts a new card, the ace of diamonds is randomly drawn and appears in position 11*a*. It can be seen that exercising the two nudge options has improved the player's hand.

The final hand of cards displayed in FIG. 5 is analyzed to determine if it is a winning hand. The final hand is a full house consisting of three aces in positions 11*a*, 11*c* and 11*d*, and two threes in positions 11*b* and 11*e*. In the upper part of video display 10 the words "WINNER!!" and "Full House—14" are displayed to inform the player that they have won, that the winning hand is a full house, and the amount of their winnings. Per the pay table shown in FIG. 13 a full house with two bets placed thereon wins fourteen credits which is the number displayed to the right of the words "Full House". Thus, the number of the player's credits is incremented from "928" to "942" as shown. The player's debit card is incremented to reflect these winnings. In addition, the words "GAME OVER" are displayed to inform the player that the first game is over.

Figure 4:
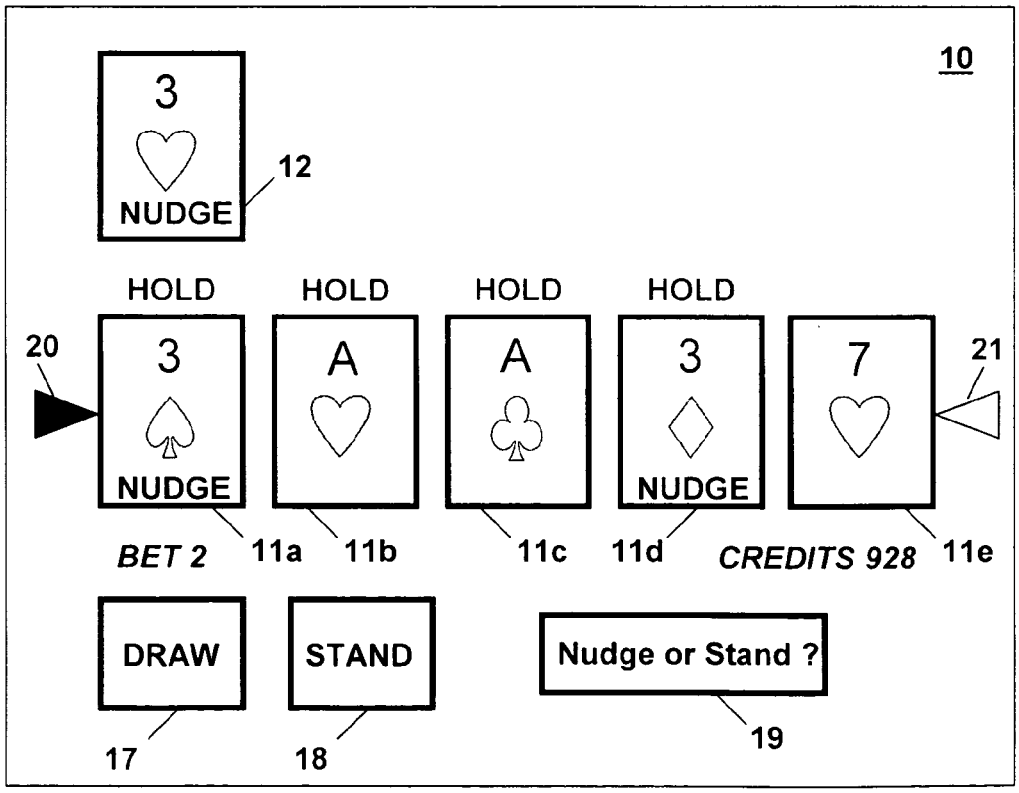
FIG. 4 shows the players hand after the player has exercised their first nudge option and has received another nudge card granting a second nudge option, and the player's preparation for exercising the second nudge option.
Figure 5:
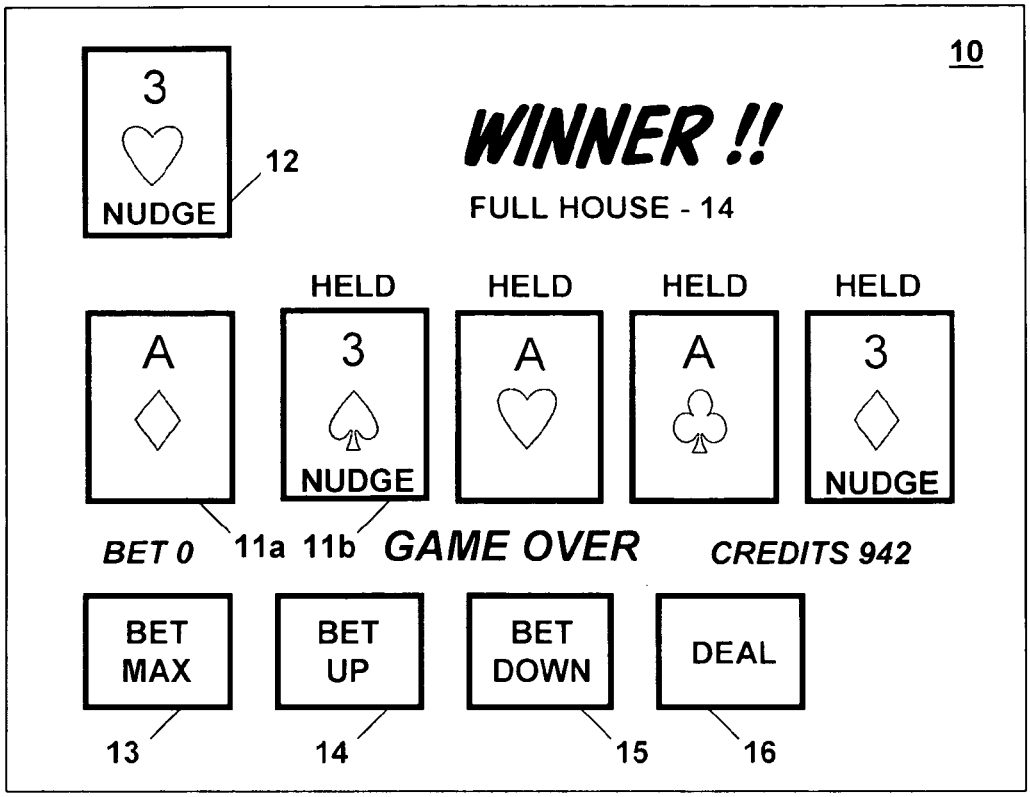
FIG. 5 shows the players hand after exercising a second nudge option following holding and redrawing cards and replacing a second card in the player's hand to get a final hand cards that is evaluated for winnings, an indication that the final hand of five cards is a winning hand, and the amount of the winnings for the first example of play of Nudge Poker.

It should be noted that buttons 17, 18 and 19 of FIGS. 3 and 4 no longer appear in FIG. 5, but have been replaced by the original buttons 13–18 that are described above with reference to FIG. 1. Also the display again reads "BET 0". The player may initiate another round of game play if they so desire.

Figure 6:
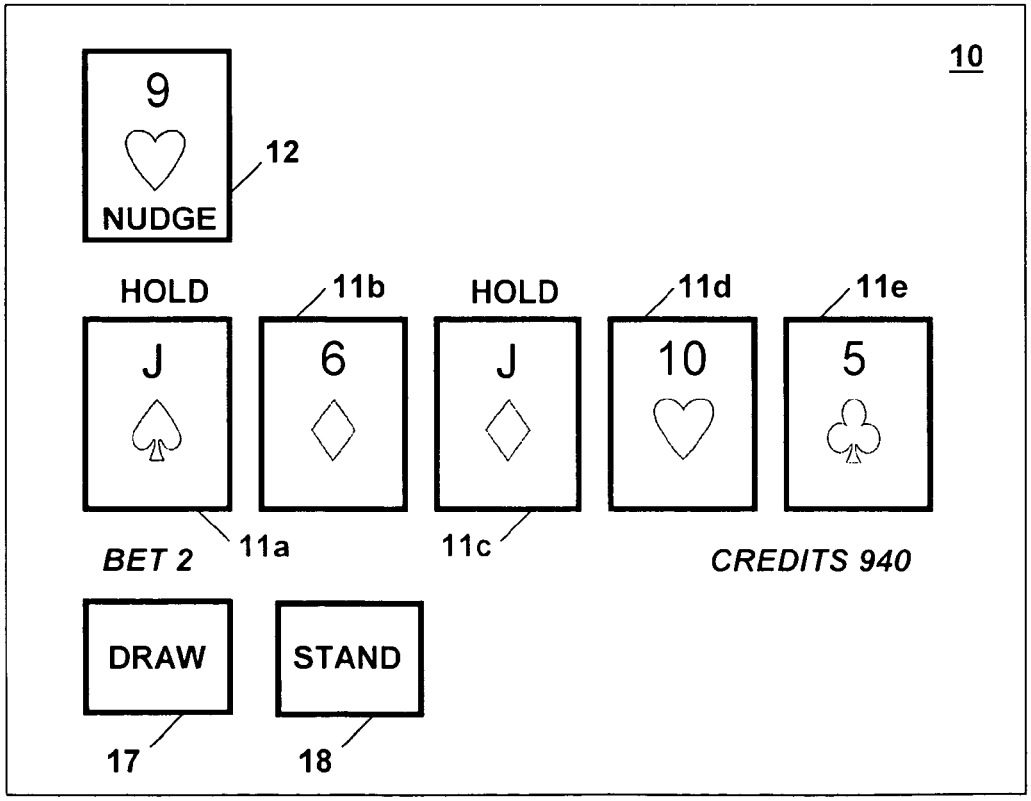
FIG. 6 shows an initial five card hand having no nudge cards initially dealt to a player in a second example of play of Nudge Poker, the cards held by the player, and the designation of a "nudge" card.

In the event that the player does not play another round of "Nudge Poker", after a period of time the display reverts to the display shown in FIG. 1. If the player wishes to play another game of "Nudge Poker" they touch ones of BET buttons 13–15 shown in FIG. 5 to place their new bet as described above with reference to FIG. 1. The player then touches Deal button 16 to deal an initial hand of five cards as shown in FIG. 6. The number of Bets placed and the remaining number of player credits available is also shown in FIG. 6.

Since the second game operation described starting with FIG. 6 is basically the same as that described for the first game that starts with FIG. 2, the following description is somewhat contracted for the sake of brevity and additional game details may be obtained by re-reading the description of the first game. The main difference is that this game is a second example of Nudge Poker in which the player does not receive a nudge card in their initial hand, but after discarding and redrawing some cards they receive a nudge card and have a nudge option. While exercising the nudge-option the player receives a second nudge card and its nudge option that they also exercise.

In FIG. 6 an initial hand of five cards is dealt into card display positions 11*a*–11*e* and there are no nudge cards. The player studies the initial hand and elects to hold the jack of spades in position 11*a* and the jack of diamonds in position 11*c*. Those card positions are touched by the player and the word "HOLD" appears adjacent to the cards in those display positions. If the player changes their mind they may re-touch positions 11*a* and/or 11*c* and the word "HOLD" disappears. If the player is initially dealt a good hand that they wish to keep they touch Stand button 18 and the game progresses to the winning determination stage described with reference to FIG. 9.

Figure 7:
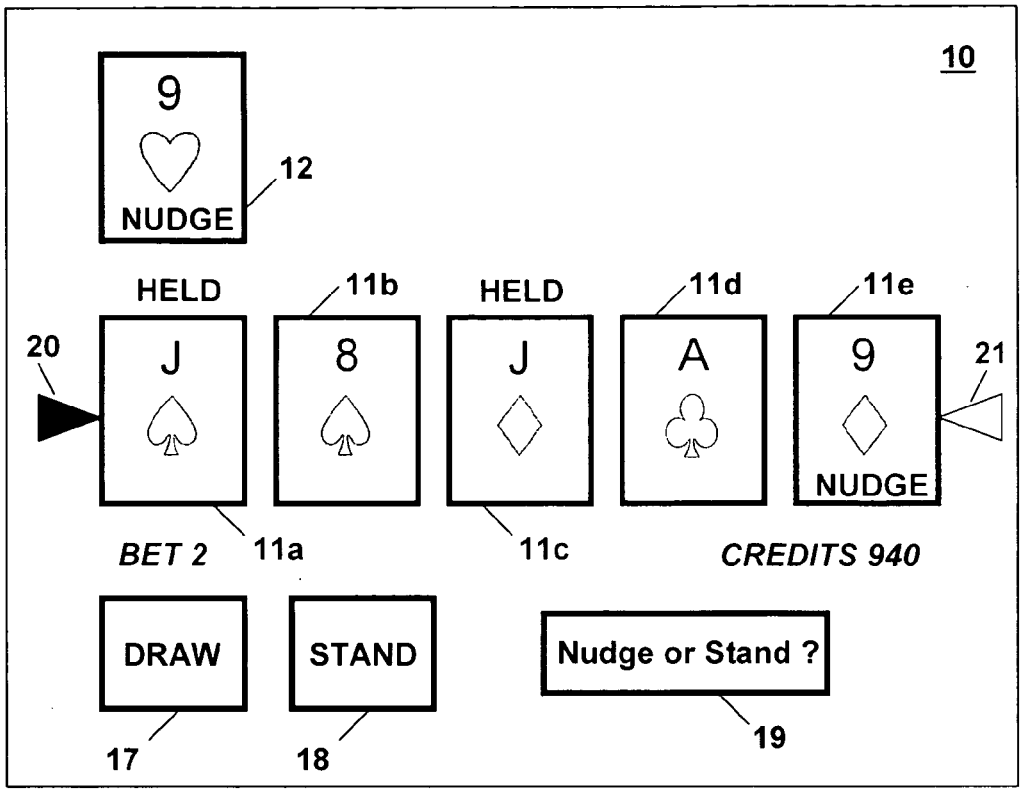
FIG. 7 shows the replacement of non-held cards for the second example of the invention, wherein a nudge card is drawn as a replacement for a discarded card, and the preparation for exercising a nudge option to improve the player's hand of cards by replacing a card in the player's hand after they have held and redrawn cards.

If Stand button 19 is not touched, after held cards have been selected the player touches Draw button 17. Video display 10 changes to that shown in FIG. 7. The non-held cards in positions 11*b*, 11*d* and 11*e* have been discarded and replaced. The six of diamonds is replaced by the eight of spades, the ten of hearts is replaced by the ace of clubs, and the five of clubs is replaced by the nine of diamonds. While there is no nudge card in the initially dealt hand of cards shown in FIG. 6, a nudge card, the nine of diamonds, is drawn as a replacement card in position 11*e* as shown in FIG. 7. Accordingly, the player receives a nudge option and the two "nudge arrows" 20 and 21 appeal on display 10 along with "Nudge or Stand?" indicator 19 in FIG. 7. Indicator 19 blinks to guide the player to touch Stand button 18, or to touch one of the nudge buttons 20 or 21. Arrows 20 and 21 may be displayed in a bright color, or be caused to blink, to draw the player's attention to the fact that the player is to consider touching one of these buttons. Although not shown, game play instructions applicable at each point in game play made may be displayed on video display 10. The player is to analyze the hand of cards shown in FIG. 7 and to decide to nudge the hand either one position to the left or one position to the right and receive one new card in accordance with the teaching of the invention.

Alternatively, if after drawing the replacement cards the player has a good hand that they wish to hold, and forego exercising the nudge option, they may touch Stand button 18.

The player has the option to touch only one of the two nudge arrows 20 and 21. If the player touches nudge arrow 20 all the cards in the hand shift one position to the right and the nine of diamonds in position 11*e* is lost. In its place a new card will appear in position 11*a*. If the player touches nudge arrow 21 all the cards in the hand shift one position to the left and the jack of spades in position 11*a* is lost. In its place a new card will appear in position 11*e*.

Figure 8:
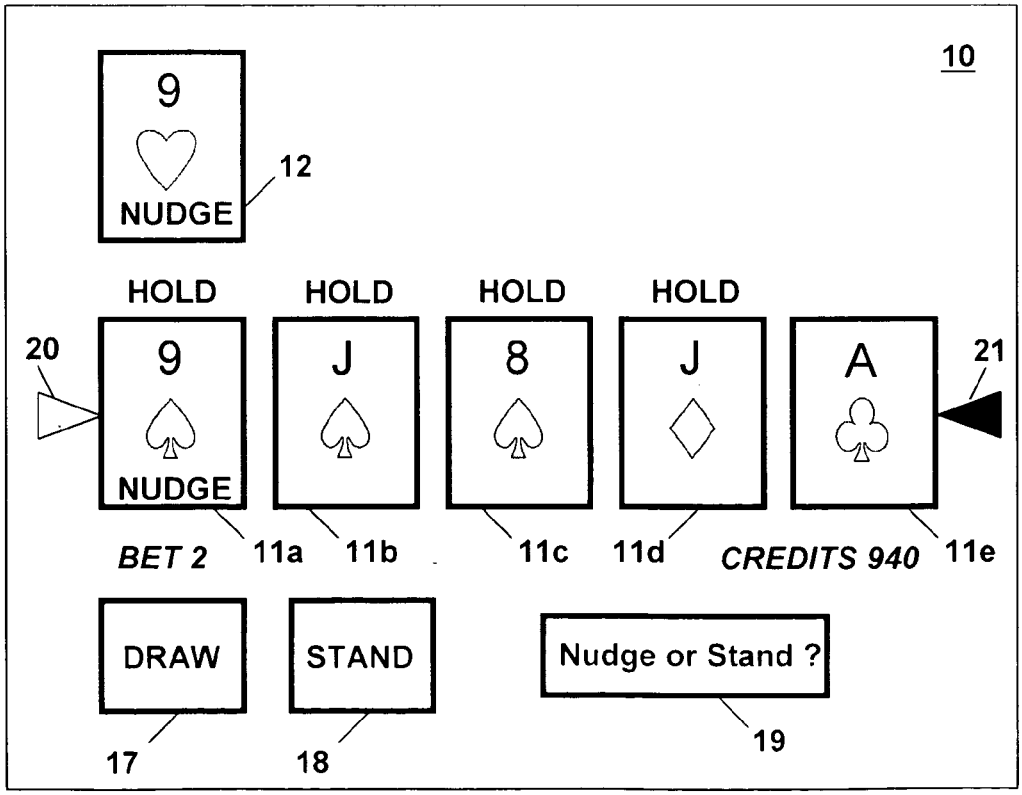
FIG. 8 shows a second nudge card received by the player after exercising their first nudge option and preparation for exercising a second "nudge" option to improve the player's hand of cards by replacing another card in the player's hand.

With this second example of Nudge Poker the player touches nudge arrow 20, which is bolded to be black only for ease of presentation to indicate that it is the chosen nudge arrow. As shown in FIG. 8 all the cards shown in the hand of FIG. 7 shift one place to the right and the nine of diamonds in position 11*e* is lost and is replaced by the nine of spades in position 11*a* as shown in FIG. 8. The player has received the draw of a replacement card per the teaching of the present invention and, in this second example, the new card is another nudge card—a nine of spades.

Being as the player has received a second nudge card as a result of exercising a first nudge option the player receives a second nudge option. As a result, in FIG. 8 nudge arrows 20 and 21 are displayed again. The player studies the hand in FIG. 8 and decides to nudge the hand of cards to the left. The nine of spades in position 11*a* is lost and is replaced by a jack of hearts in position 11*e* as shown in FIG. 9.

Figure 9:
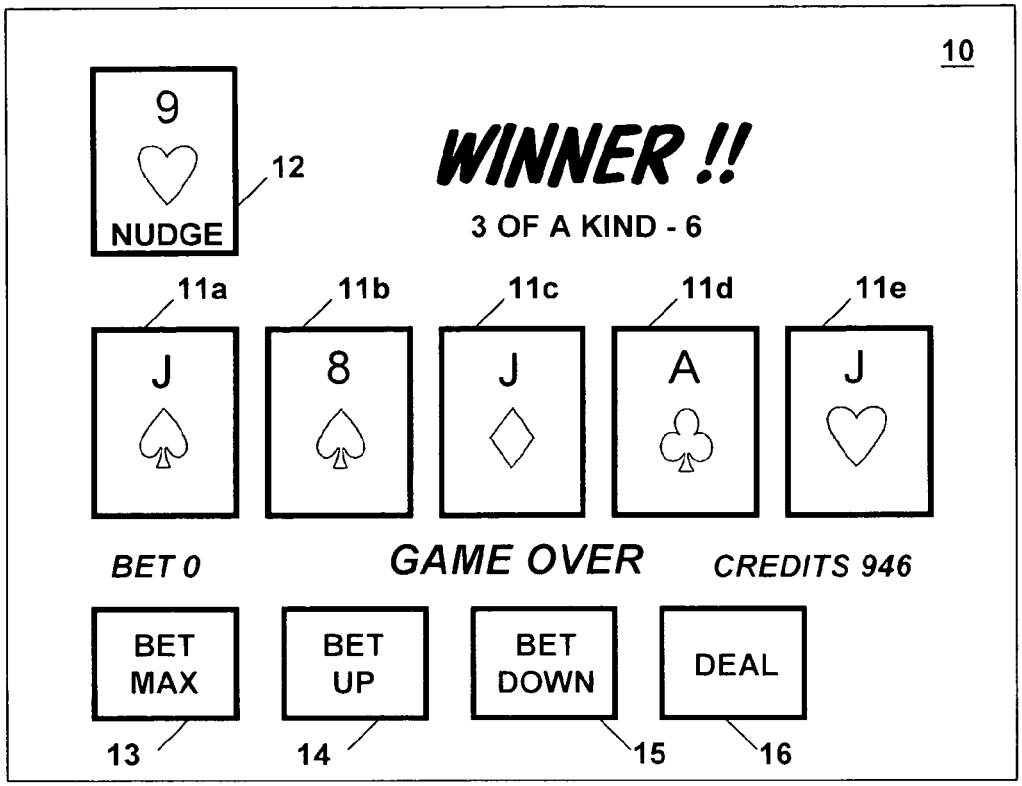
FIG. 9 shows the replacement of another one of the player's hand of cards using the second "nudge" option to arrive at a final hand of cards that is evaluated and an indication is given that the hand is a winning hand for the second example of play of Nudge Poker.

All nudge options having been exercised, the final hand of cards displayed in FIG. 9 is analyzed to determine any winnings for the hand. It can be seen in FIG. 9 that the final hand has three jacks. The exercise of the second nudge option changed the players hand from jacks or better to three jacks. In the upper part of video display 10 the words "WINNER!!" and "3 of A Kind—6" are displayed to inform the player that they have won, that they have three of a kind, and how many credits they have won. Per the pay table shown in FIG. 13, three of a kind with two bets wins six credits as displayed to the right of the words "3 of A Kind" in FIG. 9. Thus, the number of credits for the player is incremented from "940" to "946" as shown. The player's debit card is also incremented to reflect the winnings. In addition, the words "GAME OVER" are displayed to inform the player that the game is over.

It should be noted that Draw button 17, Stand button 18 and indicator 19 of FIG. 6 no longer appear in FIG. 7, but have been replaced by the original buttons 13–16. Also, the display again reads "BET 0".

In the event that the player does not play another round of "Nudge Poker", after a period of time the display reverts to the display shown in FIG. 1. If the player wishes to play another round of "Nudge Poker" all they do is touch ones of BET buttons 13–15 on the display shown in FIG. 9 to place their new bet, and then touch the Deal button 16 to deal the initial hand of five cards shown in FIG. 10. This third round of game play is a third example of the Nudge Poker game in which a player only receives a nudge card in their initial five card hand.

The display on video screen 10 is now as shown in FIG. 10. "Bet 2" is displayed and the two credit bet has been deducted from the player's previous total of "946" credits to reflect a remainder of "944" credits. Since the game operation described with reference to FIG. 8 is basically the same as that described with reference to FIG. 2, the following description is contracted for the sake of brevity and additional game details may be obtained by re-reading the first game example starting with the description of FIG. 2.

The nudge card is a jack as displayed in position 12. There is a nudge card in position 11*e* of the initially dealt five ca dr hand. The player studies the initial hand and elects to hold the ace of spades in position 11*a*, the queen of hearts in position 11*d* and the jack of clubs in position 11*e*. Those card positions are touched by the player and the word "HOLD" appears adjacent to the cards. Once the player has selected cards to be held they touch the on-screen Deal button 18 and replacement cards are dealt, as shown in FIG. 11. The non-held cards in positions 11*b* and 11*c* are discarded and respectively replaced by the seven of diamonds and the queen of clubs. None of the replacement cards is a nudge card.

Alternatively, if the player is initially dealt a good hand that they wish to keep they may touch Stand button 18 instead of touching the Draw button 17. Although not shown in FIG. 9, the held hand of cards displayed in FIG. 8 is then displayed in FIG. 9 and is analyzed to determine any winnings for the hand.

In FIG. 11 the nudge arrows 20 and 21 are displayed because of the nudge card in position 11*e*. The player studies the hand of cards in this figure and decides to exercise the nudge option by touching nudge arrow 20 and nudging the hand of cards to the right. The jack of clubs in position 11*e* is thereby lost and replaced by the ace of diamonds in position 11*a* as shown in FIG. 12. Since the one nudge option has been exercised this hand is analyzed to determine any winnings.

As shown in FIG. 12 the final hand is a winning hand of two pairs, a pair of aces and a pair of queens. The exercise of the nudge option improved the players hand from jacks or better with a pair of queens. In the upper part of video display 10 the words "WINNER!!" and "Two Pair—4" are displayed to inform the player that they have won, their winning hand, and how many credits they have won. Per the pay table shown in FIG. 13, two pair with two bets wins four credits as displayed to the right of the words "Two Pair" in FIG. 12. Thus, the number of credits for the player is incremented from "944" to "948" as shown. The player's debit card is also incremented to reflect the winnings. In addition, the words "GAME OVER" are displayed to inform the player that the game is over.

In FIG. 13 is shown an example of a pay table for the Nudge Poker game use with the three game examples described in this Detailed Description. The pay table itself does not comprise a part of the invention, and different pay tables may be utilized based on calculated odds. Shown at the left side of the pay table are topical draw poker winning hands ranging from jacks or better to a royal flush. Across the top of the table are shown the number of bets per hand, ranging from one to seven. The winnings for different winning hands at different bet levels are shown in the table. These winnings are calculated in a manner well known in the art.

Figure 14:
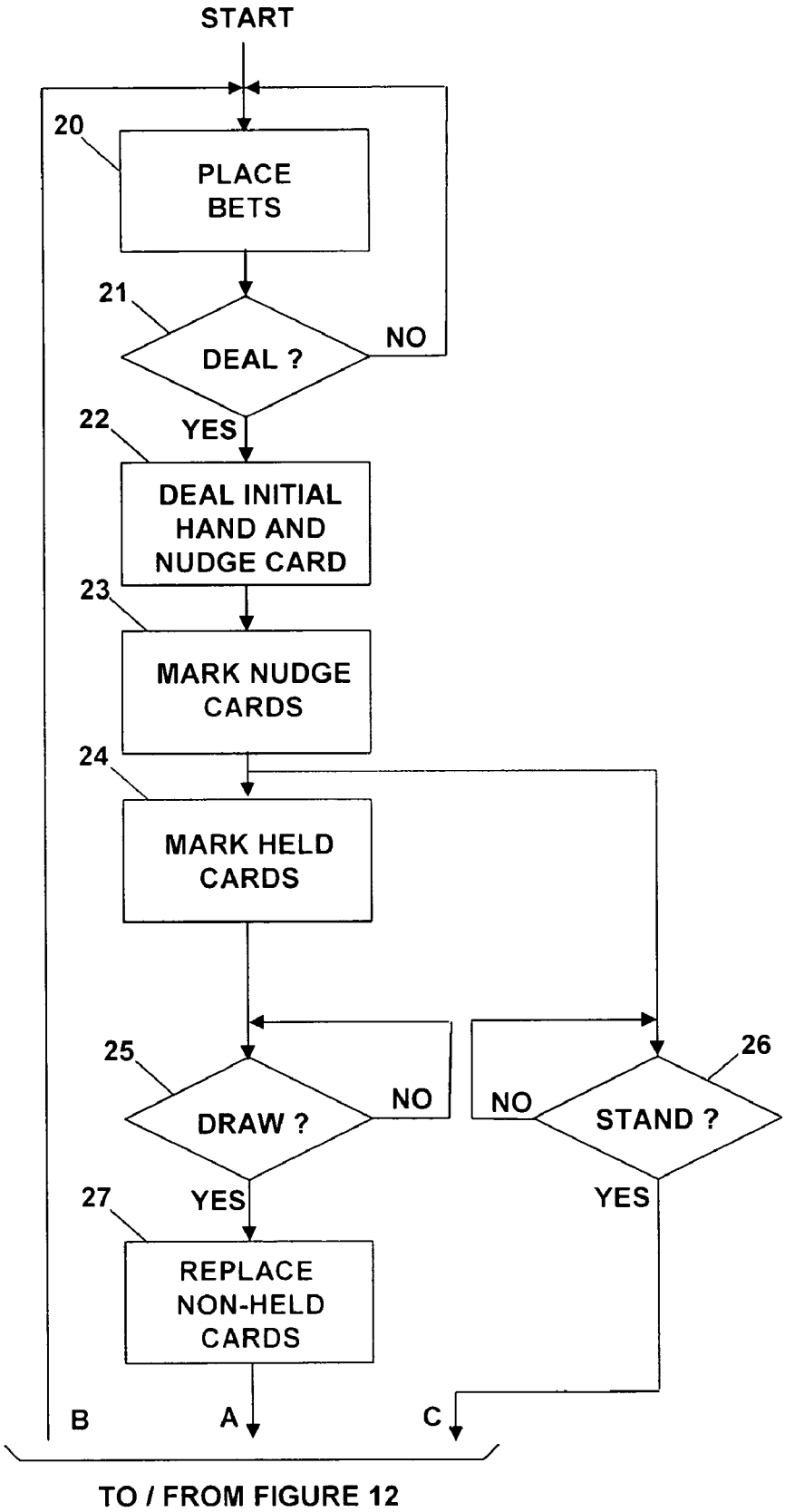
FIG. 14 shows a first part of a logical flow diagram of the steps involved in playing the first embodiment of Nudge Poker.
Figure 15:
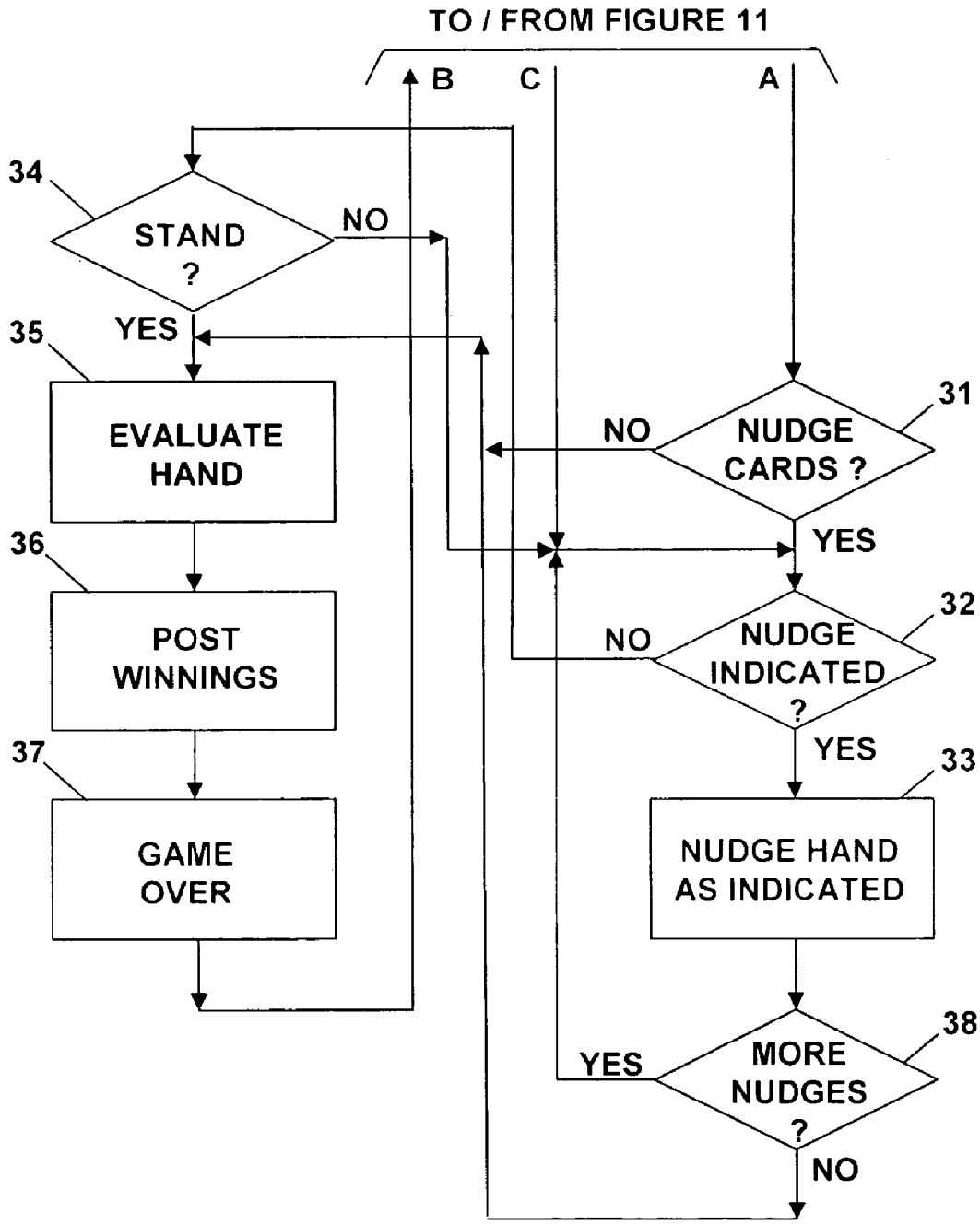
FIG. 15 shows a second part of the logical flow diagram of the steps involved in playing the first embodiment playing Nudge Poker.

FIGS. 14 and 15 show a logical flow diagram of the steps involved in playing the novel Nudge Poker game. The diagram is high level and avoids showing finer steps in playing the game in order to avoid confusion and better understand the steps of playing Nudge Poker. In the following description the steps are primarily referenced to the detailed description of the first example of the game shown in FIGS. 1 through 4, but the steps apply equally well to the second, third and all other examples of game play of Nudge Poker.

In FIG. 14 the game commences at "START" by waiting for a player to insert a debit card into a card slot (not shown) on the front of the game machine indicating that they wish to play Nudge Poker. As mentioned above, bets may be placed with the many means of payment known in the gaming industry such as coins, tokens, currency bills and debit cards, but for the sake of simplicity only debit cards are used in this description. When the game is started by a player inserting a debit card the game progresses to "Place Bets" block 20 where the game awaits the player to touch ones of the buttons Bet Max 13, Bet Up 14 and Bet Down 15, shown in FIG. 1, to place between one and seven bets on the game. The game logic knows that the player is finished placing a bet when the player touches Deal button 16 in FIG. 1.

At "Deal?" decision block 21 the game logic periodically checks for Deal button 16 being touched and exits block 21 at NO and recycles back to the input of block 20 until the Deal button 16 is touched. When the player touches Deal button 16 the game exits "Deal?" block 21 at YES and progresses to "Deal Initial Hand and Nudge Card" block 22 where the initial five card hand displayed in display positions 11*a*–11*e* of FIG. 2 are dealt. At the same time the nudge card for the game is dealt and displayed in position 12. If any cards in the initially dealt five card hand are nudge cards, having the same numerical or face value as the nudge card in position 12, at "Mark Nudge Cards" block 23 these cards are marked with the word "NUDGE" as shown in FIG. 2.

As previously described a player must make a decision at this point in game play to: (a) either hold and replace cards, or (b) stand with the cards they were initially dealt. Cards are held by the player responsive to touching ones of the display positions 11*a*–11*e*. At "Mark Held Cards" block 24 held cards, if any, are sensed and the cards are marked HELD as shown in FIG. 2. A player may not hold cards to be replaced and decide to stand as reflected by the branch to "Stand?" decision block 26. Until Stand button 18 in FIG. 2 is touched the decision made at "Stand?" block 26 is NO and the logic cycles back to the input of block 26 to continue watching for Stand button 18 to be touched. If the player decides to hold their hand of cards the game logic exits "Stand?" block 26 at YES and continues via lead C to "Nudge Indicated?" block 32 in FIG. 15. Block 32 is described further in this Detailed Description.

The game logic knows which course of action has been selected when the player touches either Draw button 17 or Stand button 18 in FIG. 2. Accordingly, at "Draw?" decision block 25 the game logic checks to see if Draw button 17 in FIG. 2 has been touched, and at "Stand?" decision block 26 the game logic checks to see if Stand button 18 in FIG. 2 has been touched. Only one of these two on screen buttons will be touched.

Until, and if, Draw button 17 in FIG. 2 is touched the decision made at "Draw?" block 25 is NO and the logic cycles back to the input of block 25 to continue sensing for Draw button 17 being touched. When the player touches Draw button 17 to replace non-held cards, the logic exits block 25 at YES to "Replace Non-Held Cards" block 27 where non-held cards in the hand shown in FIG. 2 are replaced. As previously described with reference to FIGS. 2 and 3, the two of clubs and seven of spades are respectively replaced by a king of diamonds and a three of spades.

The game logic exits block 27 and progresses via lead "A" to "Nudge Cards?" decision block 31 where a determination is made if there are any nudge cards in the hand shown in FIG. 3 after some cards are rejected and other cards drawn to replace them. If there are no nudge cards in the player's hand after redraw the only thing that can be done is to check the player's hand for winning card combinations so the game logic exits "Nudge Cards?" decision block 31 at NO and progresses to "Evaluate Hand" logic block 35 to check the hand for winning card combinations. Block 35 is described hereinafter.

However, if there are nudge cards in the redrawn hand of cards in FIG. 3 the game logic exits "Nudge Cards?" decision block 31 at YES and progresses to "Nudge Indicated?" decision block 32 where it is periodically determined if the player has touched either nudge button 20 or 21 in FIG. 3. As long as the game logic does not sense that either Nudge button 20 or 21 has been touched during the periodic checks the logic exits block 32 at NO and progresses to "Stand?" decision block 34 to determine if the player has touched Stand button 18 in FIG. 3 instead. While the player has not touched Stand button 18 the output from "Stand?" decision block 34 is NO and the logic loops back to the input of decision block 32 to continue watching for either nudge button 20 or 21 to be touched. The checking in this loop continues until either a nudge button 20 or 21 or Stand button 18 has been touched.

The player will either nudge their cards or will stand. If the player elects not to exercise a nudge option, as permitted by the presence of one or more nudge cards in the player's hand after cards have been selected and held and other cards rejected and redrawn, they do not touch a nudge button 20 or 21 and, instead, touch Stand button 18. When this occurs the logic will exit the loop described in the previous paragraph and exit block 34 at YES. The operation at block 35 is described hereinafter.

If the player has touched one of Nudge buttons 20 or 21 in FIG. 3 the game logic exits "Nudge Indicated?" decision block 32 at YES and progresses to "Nudge Hand As Indicated" logic block 33 and a player's hand of cards is nudged as the player has indicated and as shown in FIG. 4.

Since a player may have more than one nudge card in their initial hand, and they may also draw a nudge card as a replacement for a non-held card, the logic progresses to "More Nudges?" decision block 38 where it is determined if there are any unexercised nudge options. If there are unexercised nudge options the logic exits block 30 at YES and loops back to the input of "Nudge Indicated?" block 32 to watch for a player's indication of another nudge by touching one of nudge buttons 20 or 21. As previously described a player may exercise a nudge option or may stand so the logic cycles through decision block 32 and 34 watching for either decision made by the player. This loop through "More Nudges?" decision block 38 is repeated until a player has either exercised all the nudge options or has relinquished options and has chosen to stand with their hand.

In any case, if a player's hand of cards is nudged or is not nudged, the game logic ultimately exits "Stand?" decision block 34 at YES and progresses to "Evaluate Hand" block 35 where the player's final five card hand is evaluated for any winnings. A winning hand and the winnings are posted at logic block 36 as shown in FIG. 4. The game logic then progresses to "Game Over" block 37 and the game is over so the game logic returns via lead "B" to the input of "Place Bets" block 20 in FIG. 14 to await a player to commence play another game of Nudge Poker.

Figure 16:
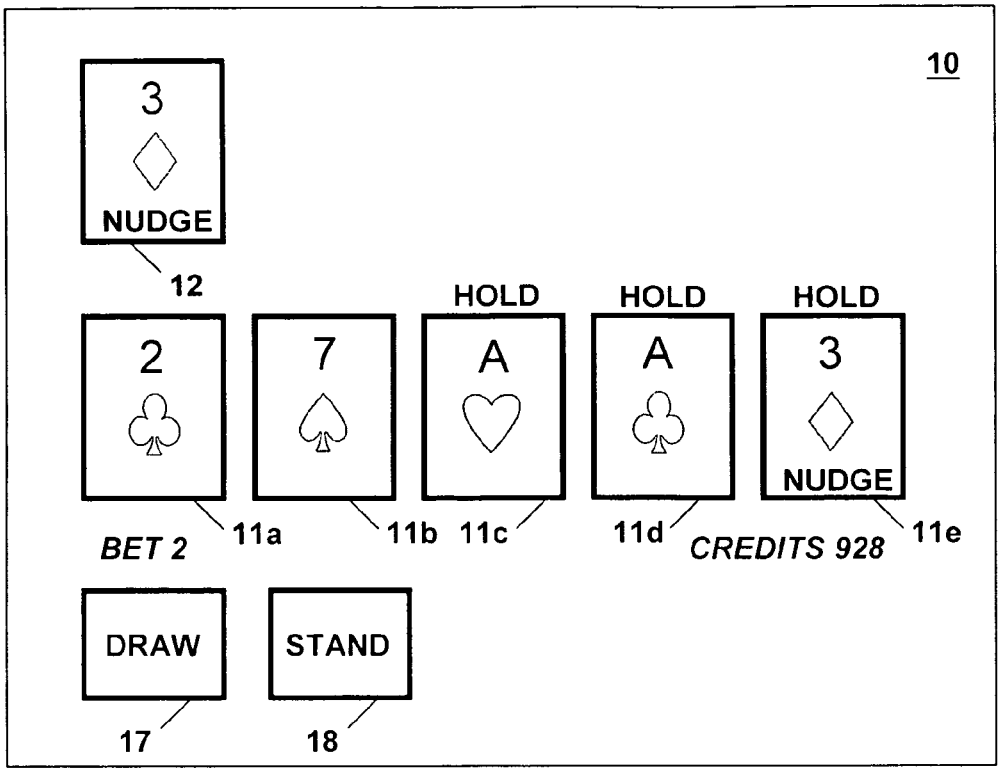
FIG. 16 shows an initial five card hand dealt to a player during an example of play of the second embodiment of the invention wherein a nudge card having a defined face value and suit is randomly selected to be the one nudge card for game play.

FIG. 16 shows the initial hand of five cards dealt after the player places one or more bets and then touches the Deal button 16 (not shown) for an example of game play of the third embodiment of the invention. A nudge card is also randomly chosen and displayed at position 12, but the card is not removed from game play and it can be displayed in any one of the five card display positions 11*a*–11*e* at any time during game play. The numerical or face value of the nudge card displayed in position 12 and also its suit, is used to identify the only "nudge card" for a game of Nudge Poker being played per this example of the third embodiment of the invention. With only a single nudge card the player's odds of being dealt a nudge card are minimized. In the game example shown in FIG. 16, the three of diamonds is displayed in position 12 so the three of diamonds becomes the one and only nudge card in the game. The one nudge card, the three of diamonds, is initially dealt to the player and is displayed in position 11*e* so the word "Nudge" is displayed with this card.

The player studies the dealt cards and elects to hold the ace of hearts in position 11*c*, the ace of clubs in position 11*d* and the three of diamonds nudge card in position 11*e*. The player then touches Draw button 17. Responsive thereto video display 10 changes to that shown in FIG. 17. The non-held two of clubs in position 11*a* is discarded and the king of diamonds is randomly drawn to replace it, and the non-held seven of spades in position 11*b* is discarded and the jack of diamonds is randomly drawn to replace it. At the same time two "nudge arrows" 20 and 21 appear on display 10 along with an indicator 19 entitled "Nudge or Stand?". The two nudge arrows 20 and 21 and indicator 19 only appear on display 10 if there is at least one nudge card in the card hand displayed in FIG. 17. Indicator 19 blinks to indicate to the player they have a choice to make. They must either: (a) elect to ignore the nudge function if they are satisfied with their new hand and touch Stand button 18, or (b) touch one of the nudge button arrows 20 or 21 to reject and replace a first a card in an attempt to improve their hand of cards.

The player has the option to touch only one of the two nudge arrows 20 and 21. If the player touches left nudge arrow 20 all the cards in the hand shown in FIG. 17 will shift one position to the right and the three of diamonds in position 11*e* is lost and will be replaced. In its place a new card will appear in position 11*a*. Similarly, if the player touches right nudge arrow 21 all the cards in the hand shift one position to the left and the king of diamonds in position 11*a* is lost and will be replaced with a new card dealt into position 11*e*.

Figure 17:
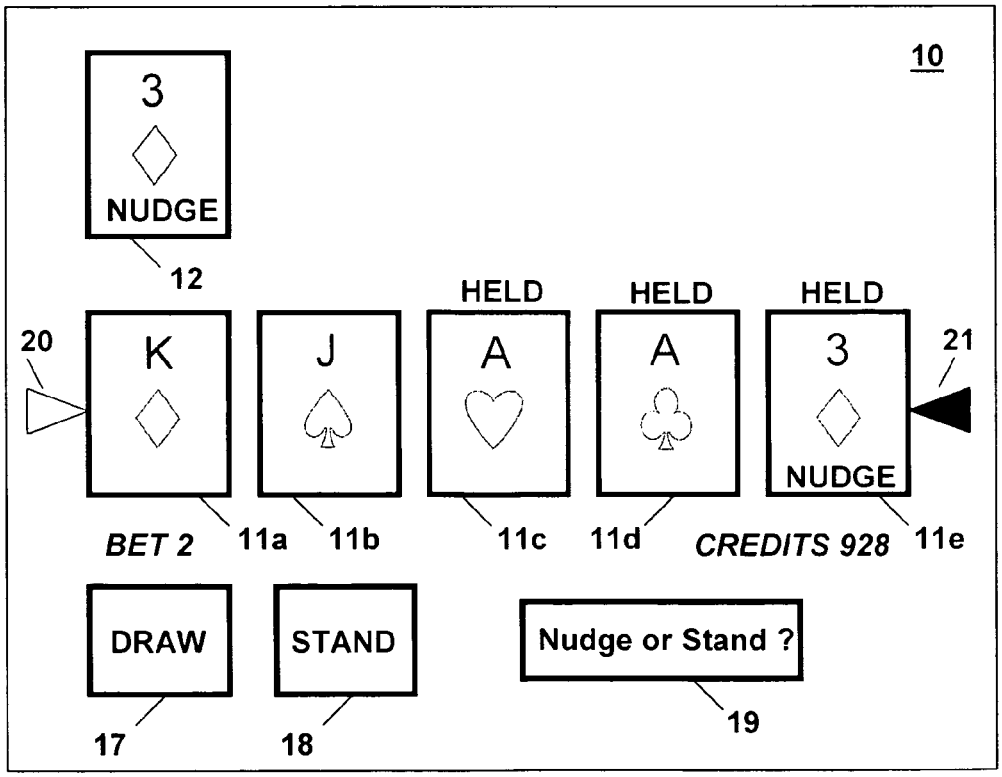
FIG. 17 shows the replacement of non-held cards for the example of game play of the second embodiment of the invention and the exercising of a nudge option to improve the player's hand of cards.

In the present example the player touches nudge arrow 21 in FIG. 17, which is bolded to be black only for ease of presentation and to indicate that it is the chosen nudge arrow. All the cards in the hand shift one position to the left and the king of diamonds in position 11*a* is lost. In place of the king of diamonds the ace of hearts is randomly drawn and appears in position 11*e* as shown in FIG. 18.

Figure 18:
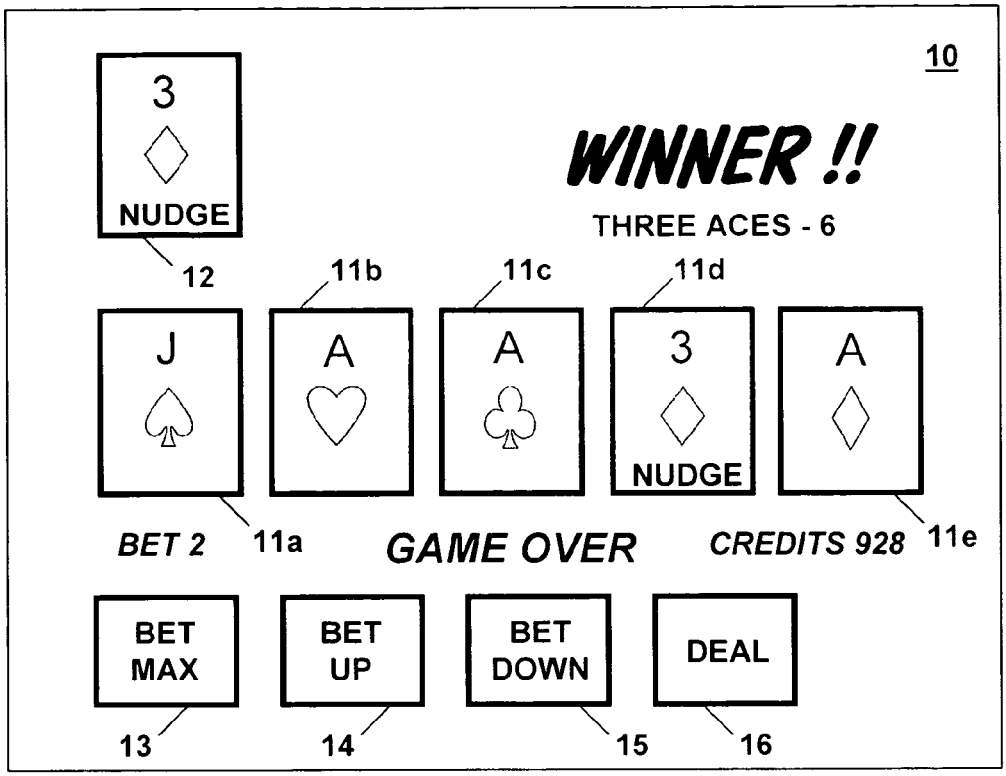
FIG. 18 shows the players final hand of cards that is evaluated for winnings after the player has exercised their nudge option, an indication that the hand of cards is a winning hand, and the amount of the winnings for the example of game play of the second embodiment of the invention.

The final hand of cards displayed in FIG. 18 is analyzed to determine if it is a winning hand. The final hand is three aces in positions 11*b*, 11*c* and 11*e*. In the upper part of video display 10 the words "WINNER!!" and "Three Aces—6" are displayed to inform the player that they have won, that the winning hand is three aces, and the amount of their winnings. Per the pay table shown in FIG. 13 three aces with two bets placed thereon wins six credits. In addition, the words "GAME OVER" are displayed to inform the player that the game play for the example of the second embodiment of the invention is over.

Figure 19:
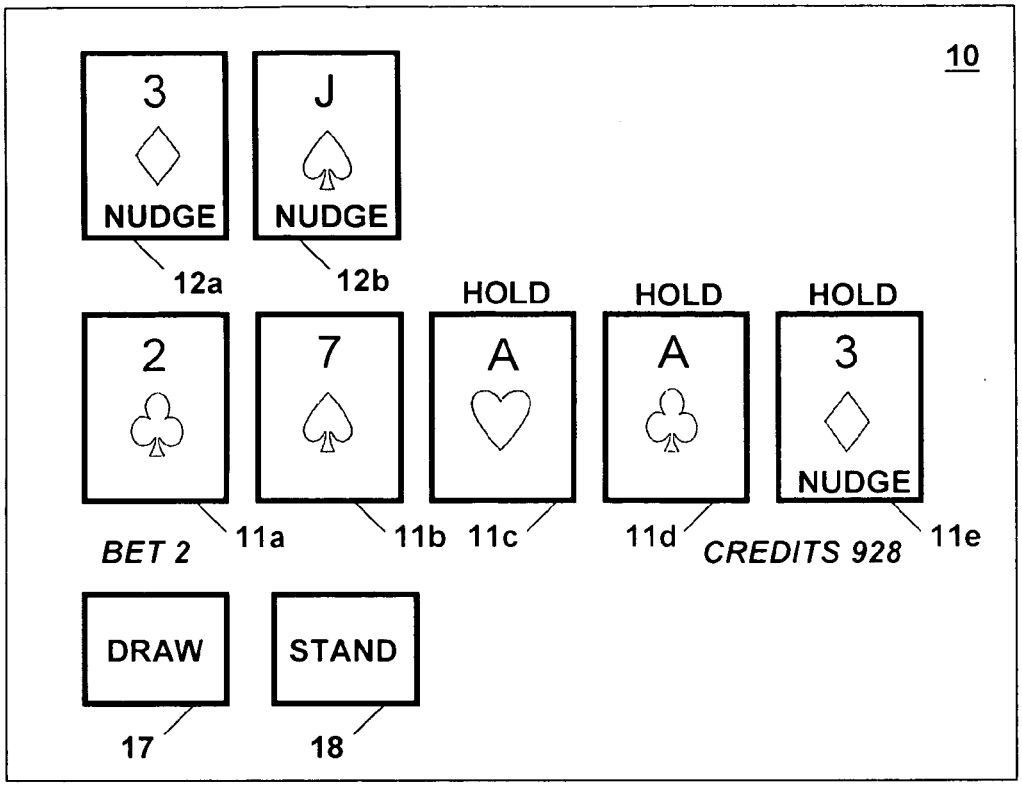
FIG. 19 shows an initial five card hand dealt to a player for an example of play of the third embodiment of the invention wherein multiple nudge card are randomly picked for game play.
Figure 20:
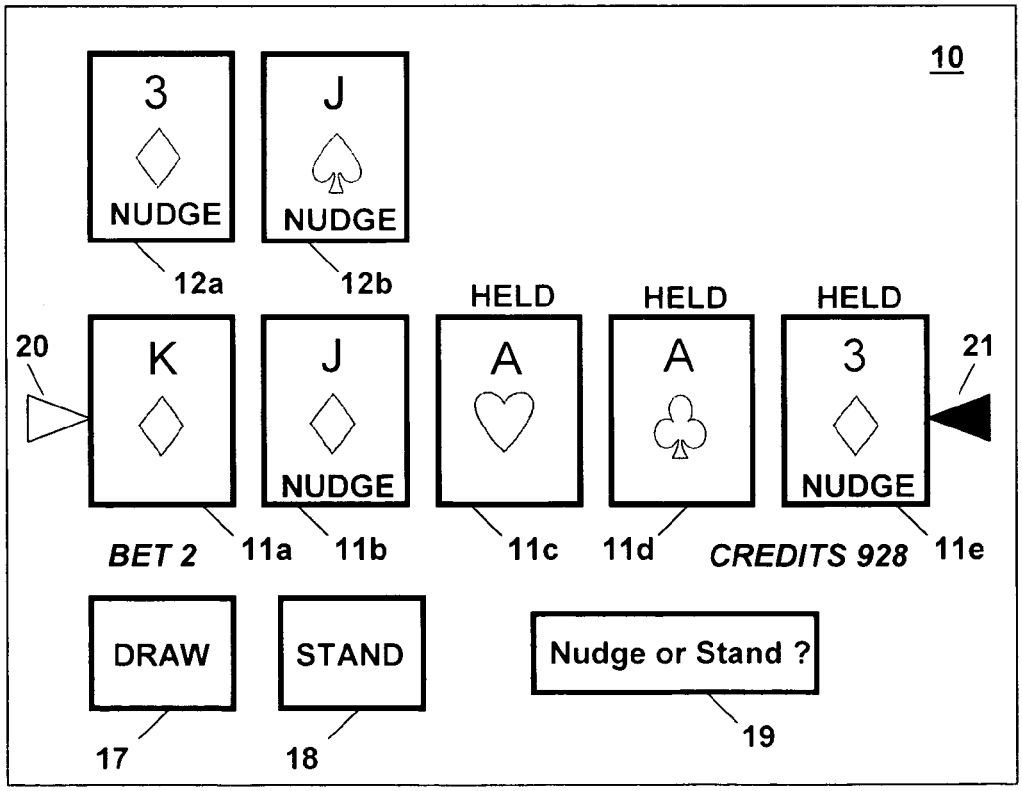
FIG. 20 shows the replacement of non-held cards for the example of play of the third embodiment of the invention, and performance of a first nudge option to improve the player's hand of cards by replacing a card in the player's hand.

In FIG. 19 is shown an initial five card hand dealt to a player during an example of play of the third embodiment of the invention, cards held by the player, and the designation of more than one "nudge" card for each round of game play. Displayed on video display screen 10 are the number of bets wagered by a player on a game, and the balance of the number of credits indicated on the players debit card. In FIG. 19 the player starts with "930" credits (not shown) and, after placing two bets on the first example of the game, the player has "928" credits remaining.

When the player touches Deal button 16 the first time an initial hand of five cards is dealt as shown in FIG. 19. In this example of game play of the third embodiment of the invention two nudge cards are randomly chosen and displayed at positions 12*a* and 12*b*, but the two cards are not removed from game play and they can be displayed in any one of the five card display positions 11*a*–11*e* at any time during game play, as shown with the three of diamonds. During this example of game play the three of diamonds is displayed in position 12*a* and the jack of spades is displayed in position 12*b* so they are the two nudge cards for the game. There is a three of diamonds nudge card displayed in display position 11*e* and the word "Nudge" is displayed with this card. The two nudge cards in positions 12*a* and 12*b* may be of the same face value or the same suit.

The player studies the initial hand of five cards dealt into display positions 11*a*–11*e* in FIG. 19 and makes a decision as to which of the cards are to be held and which of the cards are to be discarded and redrawn in a manner well known in the draw poker art.

From the initially dealt hand of cards displayed in FIG. 19 the player elects to hold the ace of hearts in position 11*c*, the ace of clubs in position 11*d* and the three of diamonds in position 11*e*. The player selects the cards to be held by physically touching the display positions 11*c*, 11*d* and 11*e* on video display 10. A player may change their mind at any time before either Draw button 17 or Stand button 18 is touched and again touch a display position to reverse their election as to a held card.

After held cards have been selected the player touches Draw button 15 again. Responsive thereto video display 10 changes to that shown in FIG. 20. The non-held two of clubs in 11*a* is discarded and the king of diamonds is randomly drawn to replace it, and the non-held seven of spades in position 11*b* is discarded and the jack of diamonds is randomly drawn to replace it. At the same time two "nudge arrows" 20 and 21 appear on display 10 along with an indicator 19 entitled "Nudge or Stand?". The two nudge arrows 20 and 21 and indicator 19 only appear on display 10 if there is at least one nudge card in the card hand displayed in FIG. 20. After the card discard and draw there are two nudge cards in positions 11*b* and 11*e*. The player thus has two nudge options that may be exercised to replace two cards in their hand. Indicator 19 blinks to indicate to the player they have a choice to make. They must either: (a) elect to ignore the nudge function if they are satisfied with their new hand and touch Stand button 18, or (b) touch one of the nudge button arrows 20 or 21 to reject and replace a first of a maximum of two cards in an attempt to improve their hand of cards.

The player has the option to touch only one of the two nudge arrows 20 and 21. If the player touches left nudge arrow 20 all the cards in the hand shown in FIG. 20 will shift one position to the right and the three of diamonds in position 11*e* is lost and will be replaced. In its place a new card will appear in position 11*a*. Similarly, if the player touches right nudge arrow 21 all the cards in the hand shift one position to the left and the king of diamonds in position 11*a* is lost and will be replaced with a new card dealt into position 11*e*.

In the present example the player touches nudge arrow 21, which is bolded to be black only for ease of presentation and to indicate that it is the chosen nudge arrow. All the cards in the hand shift one position to the left and the king of diamonds in position 11*a* is lost. In place of the king of diamonds the seven of hearts is randomly drawn and appears in position 11*e* as shown in FIG. 21.

Figure 21:
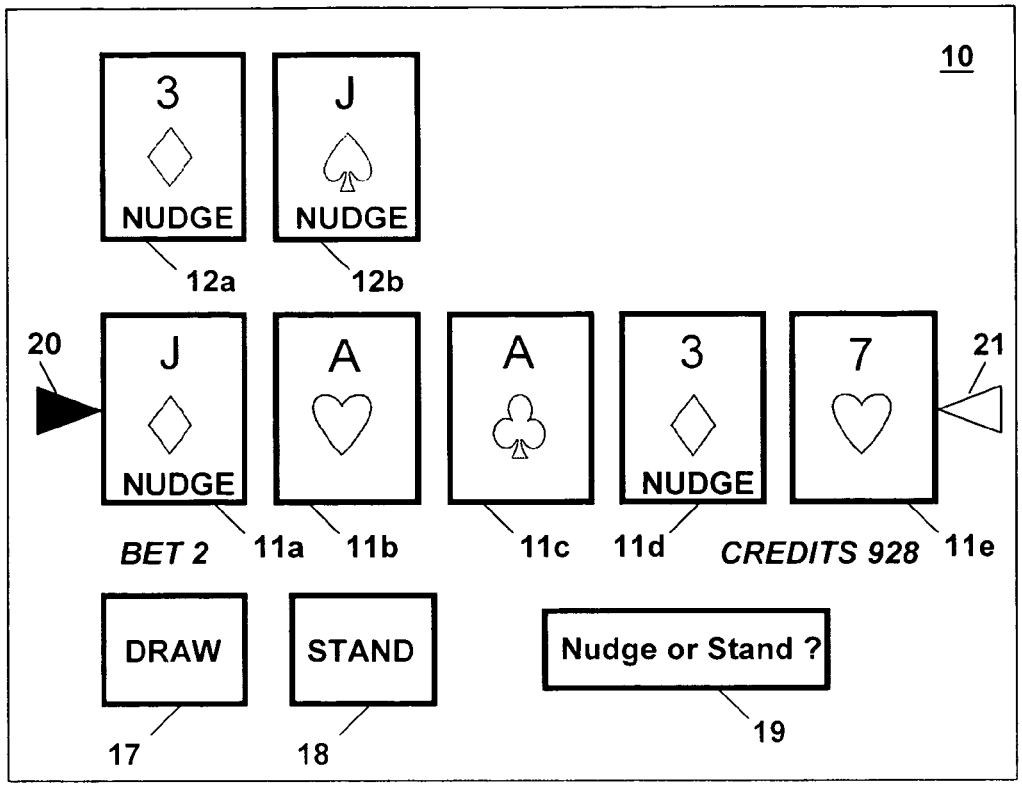
FIG. 21 shows the players hand after the player has exercised their one nudge option and is exercising a second nudge option to improve the player's hand of cards by replacing another card in the player's hand.
Figure 22:
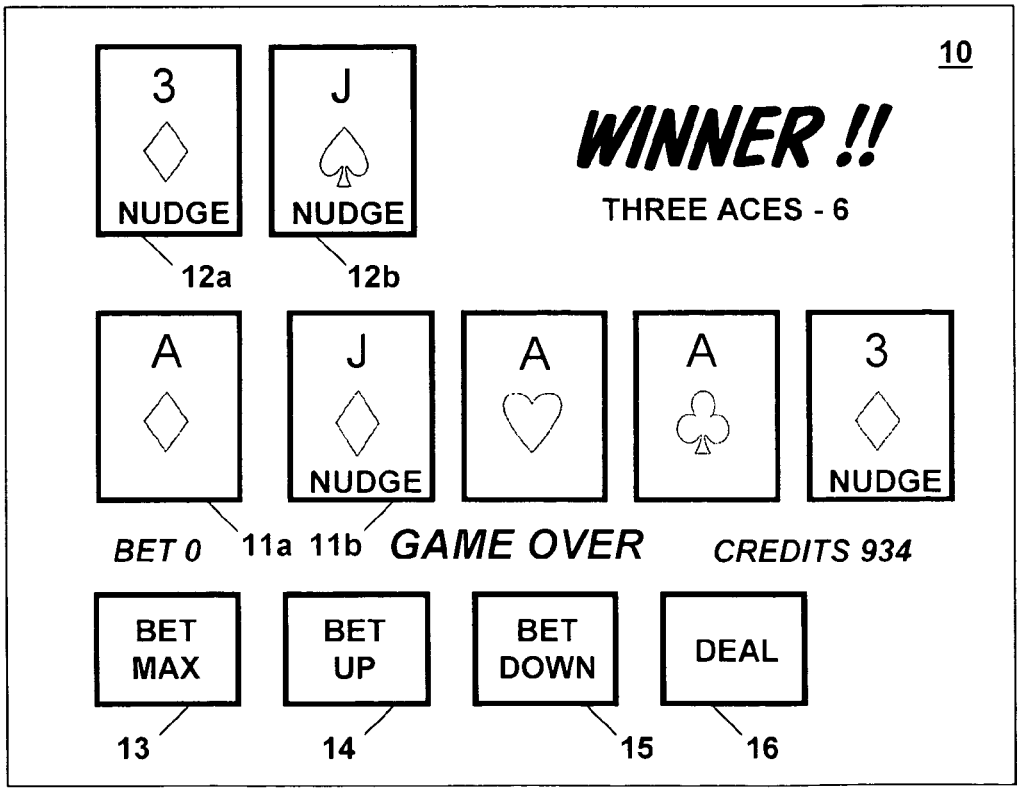
FIG. 22 shows the player's final hand of cards that is evaluated for winnings, an indication that the final hand of five cards is a winning hand, and the amount of the winnings for the example of play of the third embodiment of the invention.

The player has exercised the first nudge option and has one nudge option remaining, so nudge arrows 20 and 21 are again shown with the hand of cards in FIG. 21. After again studying the hand of cards the player decides to nudge the cards to the right and touches nudge arrow 20. The final hand of five cards is shown in FIG. 22. In place of the seven of hearts in position 11*e* an ace of diamonds is randomly drawn and appears in position 11*a*. It can be seen that exercising the two nudge options has improved the player's hand from two aces to three aces.

The final hand of cards displayed in FIG. 22 is analyzed to determine if it is a winning hand. The final hand is three aces in positions 11*a*, 11*c* and 11*d*. In the upper part of video display 10 the words "WINNER!!" and "Three Aces—6" are displayed to inform the player that they have won, that the winning hand is three aces, and the amount of their winnings. Per the pay table shown in FIG. 13 three aces with two bets placed thereon wins six credits. Thus, the number of the player's credits is incremented from "928" to "934" as shown. The player's debit card is incremented to reflect these winnings. In addition, the words "GAME OVER" are displayed to inform the player that game play for the example of the third embodiment of the invention is over.

Figure 23:
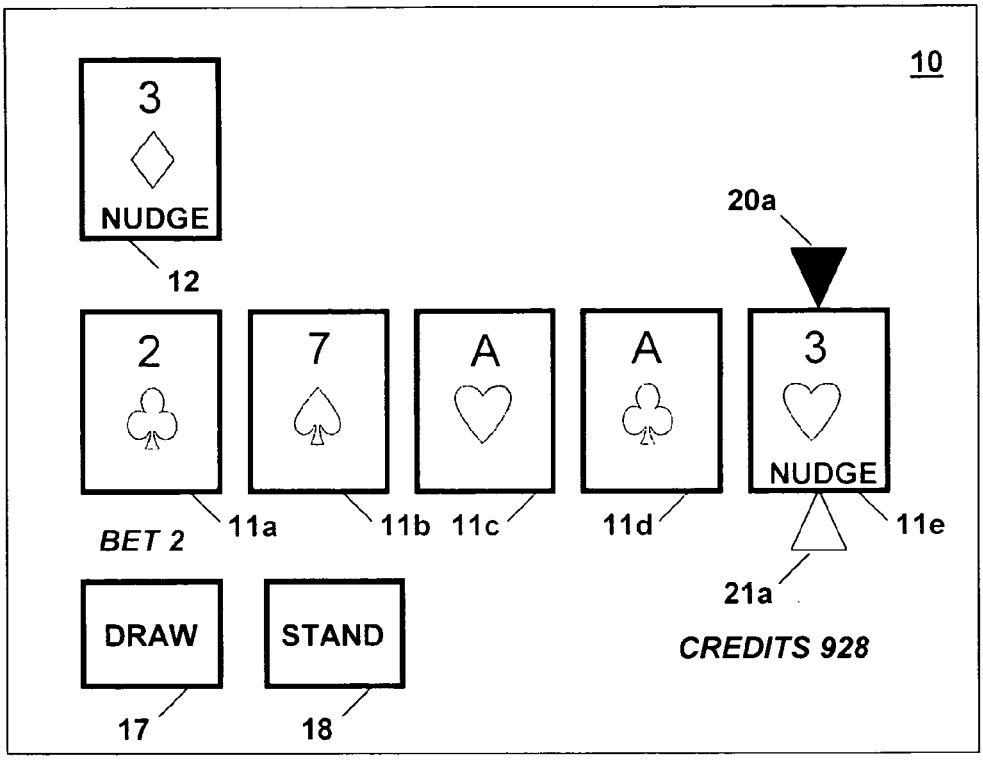
FIG. 23 shows an initial five card hand dealt to a player during an example of game play of a fourth embodiment of the invention wherein a card is randomly selected and its face value determines the nudge cards for game play and wherein when a nudge option is exercised the nudge card itself held by the player is replaced.

FIG. 23 shows the initial hand of five cards dealt after the player places one or more bets and then touches the Deal button 16 (not shorten) for an example of the fourth embodiment of the invention. In the fourth embodiment of the invention only nudge cards in a player's hand of cards are replaced when they exercise a nudge option. A nudge card is also randomly chosen and displayed at position 12, but the card is not removed from game play and it can be displayed in any one of the five card display positions 11*a*–11*e* at any time during game play. The numerical or face value of the nudge card displayed in position 12 and also its suit, is used to identify the "nudge card" for a particular game of Nudge Poker being played per the fourth embodiment of the invention. In the game example shown in FIG. 23, the three of diamonds is displayed in position 12 so threes become the nudge cards. A nudge card, the three of hearts, is initially dealt to the player and is displayed in position 11*e* so the word "Nudge" is displayed with this card.

It should be noted that nudge arrows 20*a* and 21*a* appear above and below the nudge card in position 11*e* versus at the ends of the rows of cards as shown in all other examples of embodiments of the invention. This is because with the fourth embodiment of the invention only nudge cards are replaced when exercising a nudge option, not cards at the right or left end of the displayed hand of cards. The nudge option is obtained no matter when a nudge card is dealt to a player, including as a result of exercising a previous nudge option.

When a nudge card is dealt to a player and nudge arrows are displayed, as in FIG. 23, if a player touches arrow 20*a* the card that is immediately above the nudge card in the deck of cards will be dealt to replace the nudge card. Further, if a player touches arrow 21*a* the card that is immediately below the nudge card in the deck of cards will be dealt to replace the nudge card.

With the game example shown the player touches nudge arrow 20*a*, which is bolded to be black only for ease of presentation and to indicate that it is the chosen nudge arrow. Thus, the three of diamonds is replaced by the card that is immediately above the three of diamonds in the deck of cards. In the example of the fourth embodiment of the invention shown in FIG. 23 the three of hearts is replaced by the seven of hearts as shown in FIG. 24 to yield the player's final hand of cards.

Figure 24:
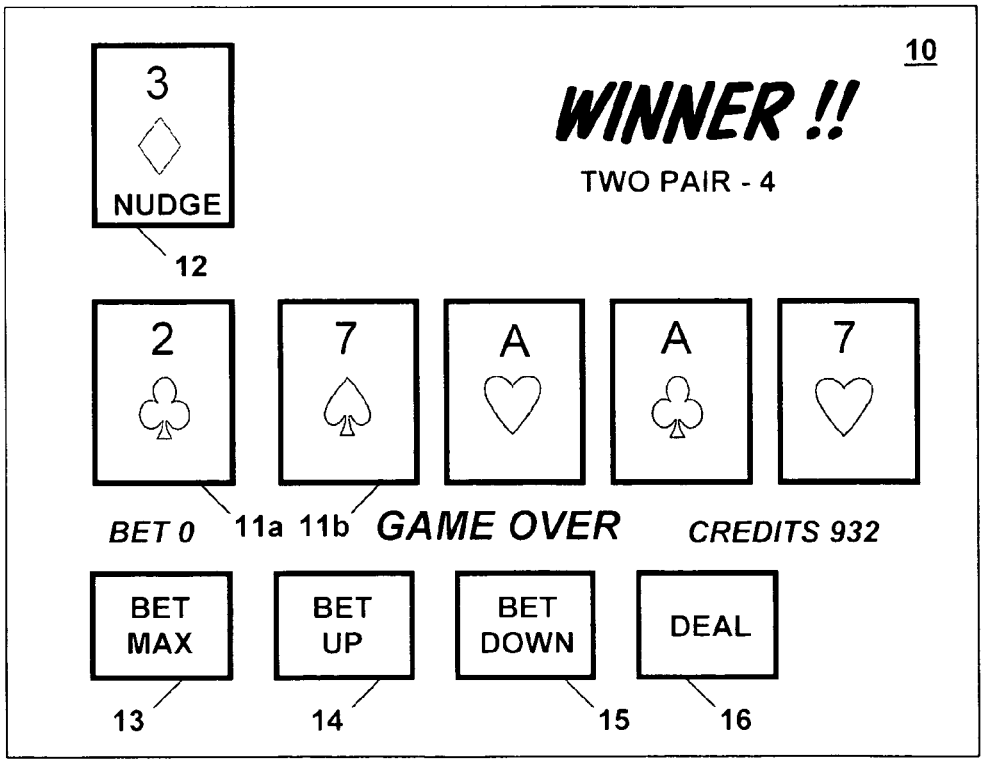
FIG. 24 shows the final hand of cards after the nudge card has been replaced by exercising the player's nudge option in the example of game play of a fourth embodiment of the invention.

The final hand of cards displayed in FIG. 24 is analyzed to determine if it is a winning hand. The final hand is two pairs—aces in positions 11*c* and 11*d* and sevens in positions 11*b* and 11*e*. In the upper part of video display 10 the words "WINNER!!" and "Two Pair—4" are displayed to inform the player that they have won, that the winning hand is two pairs, and the amount of their winnings. Per the pay table shown in FIG. 13 two pairs with two bets placed thereon wins four credits. In addition, the words "GAME OVER" are displayed to inform the player that the game play for the example of the fourth embodiment of the invention is over.

What has been described herein are three examples of the preferred embodiment of the invention it will be understood by those skilled in the art that numerous changes may be made without departing from the spirit and scope of the invention. For example, if a player is initially dealt a nudge card but decides to discard it and redraw another card, they will retain the nudge option that they received when the nudge card was dealt. In addition, combinations of the features of the different examples of game playoff the different embodiments of the invention described or merely, referenced may be combined.

The invention claimed is:

1. A method of playing a modified draw poker game using a deck of cards wherein a player has a chance to hold cards and to reject and replace other cards during the course of game play, the method comprising the steps of:

(a) dealing an initial hand of cards to a player and displaying them in a line having two ends;

(b) identifying the face value and/or suit of one(s) of the cards in the deck of cards and displaying the identified face value and/or suit apart from and at the same time that the initial hand of cards is dealt in step (a);

(c) drawing replacement cards for cards rejected by the player and not to be held from the initial hand of cards;

(d) granting a first option to the player to replace additional cards in their hand of cards after drawing replacement cards in step (c) for each card in their hand of cards having the face value and/or suit identified in step (b);

(e) replacing a card in the player's hand of cards when the player exercises a first option granted in step (d), the card to be replaced being from one of the two ends of the line of cards as selected by the player; and (f) determining if the player's hand of cards is a winning hand of cards.

2. The method of playing a modified poker game in accordance with claim 1 further comprising the step of granting the player a bonus game after a predetermined number of modified poker games have been played, and during the bonus game the player may exercise any accumulated first options that are not exercised dining the preceding predetermined number of modified poker games.

3. The method of playing a modified poker game in accordance with claim 1 wherein the player has a second option to stand and not exercise their first options at any time during game play.

4. The method of playing a modified poker game in accordance with claim 3 wherein the player may: (i) be dealt cards in their initial hand of cards that have the face value and/or suit of one(s) of the cards identified in step (b), (ii) draw cards having thereon the last mentioned face value and/or suit as a result of rejecting and redrawing cards in step (c), and (iii) receive a replacement card with the last mentioned face value and/or suit as a result of exercising a first option granted in step (d), and wherein the player may exercise a first option at any time after they may reject and draw cards per step (c).

5. The method of playing a modified poker game in accordance with claim 1 wherein the player may: (i) be dealt cards in their initial hand of cards that have the face value and/or suit of one(s) of the cards identified in step (b), (ii) draw cards having the last mentioned face value and/or suit as a result of rejecting and redrawing cards in step (c), and (iii) receive a replacement card with the last mentioned face value and/or suit as a result of exercising a first option granted in step (d), and wherein the player may exercise a first option at any time after they may reject and draw cards per step (c).

6. The method of playing a modified poker game in accordance with claim 5 further comprising the step of granting the player a bonus game after a predetermined number of modified poker games have been played, and during the bonus game the player may exercise any accumulated first options that are not exercised during the preceding predetermined number of modified poker games.

7. The method of playing a modified poker game in accordance with claim 6 wherein the player has a second option to stand and not exercise their first options at any time during game play.

8. The method of playing a modified poker game in accordance with claim 1 wherein the first option to replace an additional card is to replace only cards in the player's hand of cards having the same face value as the card(s) identified in step (b).

9. The method of playing a modified poker game in accordance with claim 8 wherein the player may: (i) be dealt cards in their initial hand of cards that have the same face value as the one(s) of the card(s) identified in step (b), (ii) draw cards having the same face value as the one(s) of the card(s) identified in step (b) as a result of rejecting and redrawing cards in step (c), and (iii) receive a replacement card with the same face value as the card(s) identified in step (b) as a result of exercising a first option, and wherein the player may exercise a first option at any time after they reject and redraw cards.

10. The method of playing a modified poker game in accordance with claim 1 wherein the first option to replace an additional card is to replace only cards in the player's hand of cards having the same suit as the card(s) identified in step (b).

11. The method of playing a modified poker game in accordance with claim 10 wherein the player may: (i) be dealt cards in their initial hand of cards that have the same face value as the one(s) of the card(s) identified in step (b), (ii) draw cards having the same face value as the one(s) of the card(s) identified in step (b) as a result of rejecting and redrawing cards in step (c), and (iii) receive a replacement card with the same face value as the card(s) identified in step (b) as a result of exercising a first option, and wherein the player may exercise a first option at any time after they reject and redraw cards.

12. A method of playing a modified draw poker game using a deck of cards wherein a player has a chance to hold cards and to reject and replace other cards during the course of game play, the method comprising the steps of:

(a) dealing an initial hand of cards to a player and displaying them in a line having two ends;

(b) identitying the face value and/or suit of one(s) of the cards in the deck of cards at the same time that the initial hand of cards is dealt in step (a);

(c) drawing replacement cards for cards rejected by the player and not to be held from the initial hand of cards;

(d) granting a first option to the player to replace additional cards in their hand of cards after drawing replacement cards in step (c) for each card in their hand of cards having the face value and suit identified in step (b);

(e) replacing a card in the player's hand of cards when the player exercises a first option granted in step (d), the card to be replaced being from one of the two ends of the line ofr cards as selected by the player;

(f) repeating steps (d) and (e) when the player exercises a first option and draws a replacement card having the unique indicia thereon; and (g) determining if the player's hand of cards is a winning hand of cards.

13. The method of playing a modified poker game in accordance with claim 12 wherein the first option to replace an additional card is to replace only cards in the player's hand of cards that have the same face value and/or suit as identified in step (b).

14. The method of playing a modified poker game in accordance with claim 12 further comprising the step of granting the player a bonus game after a predetermined number of modified poker games have been played, and during the bonus game the player may exercise any accumulated first options that are not exercised during the preceding predetermined number of modified poker games.

15. The method of playing a modified poker game in accordance with claim 12 wherein the player has a second option to stand and not exercise their first options at any time during game play.

16. The method of playing a modified poker game in accordance with claim 15 wherein the player may: (i) be dealt cards in their initial hand of cards that have the face value and/or suit of one(s) of the cards identified in step (b), (ii) draw cards having thereon the last mentioned face value and/or suit as a result of rejecting and redrawing cards in step (c), and (iii) receive a replacement card with the last mentioned face value and/or suit as a result of exercising a first option granted in step (d), and wherein the player may exercise a first option at any time after they may reject and draw cards per step (c).

17. The method of playing a modified poker game in accordance with claim 12 wherein the player may: (i) be dealt cards in their initial hand of cards that have the face value and/or suit of one(s) of the cards identified in step (b), (ii) draw cards having thereon the last mentioned face value and/or suit as a result of rejecting and redrawing cards in step (c), and (iii) receive a replacement card with the last mentioned face value and/or suit as a result of exercising a first option granted in step (d), and wherein the player may exercise a first option at any time after they may reject and draw cards per step (c).

18. A computer readable medium containing computer executable instructions for playing a modified draw poker game using a deck of cards wherein a player has a chance to hold cards and to reject and replace other cards during the course of game play, the executable program instructions comprising instructions for:

(a) dealing an initial hand of cards to a player and displaying them in a line having two ends;

(b) indetifying the face value and/or suit of ones(s) of the cards in the deck of cards at the same time that the initial hand of cards is dealt in step (a);

(c) drawing replacement cards for cards rejected by the player and not to be held from the initial band of cards;

(d) granting a first option to the player to replace additional cards in their band of cards after drawing replacement cards in step (c) for each card in their band of cards having the unique indicia thereon;

(e) replacing a card in the player's hand of cards when the player exercises a first option granted in step (d), the card to be replaced being from one of the two ends of the line of cards as selected by the player; and (f) determining if the player's hand of cards is a winning hand of cards.

19. The computer readable medium containing computer executable instructions for playing a modified draw poker game in accordance with claim 18 wherein at least one card in the deck of cards is randomly dealt at the same time that the initial hand of cards is dealt and the face value and/or suit of the randomly dealt card(s) are identified in step (b).

20. A computer readable medium containing computer executable instructions for playing a modified draw poker game using a deck of cards wherein a player has a chance to hold cards and to reject and replace other cards during the course of game play, the executable program instructions comprising instructions for:

(a) dealing an initial hand of cards to a player and displaying them in a line having two ends;

(b) identifying the face value and/or suit of ones(s) of the cards in the deck of cards at the same time that the initial hand of cards is dealt in step (a);

(c) drawing replacement cards for cards rejected by the player and not to be held from the initial hand of cards;

(d) granting a first option to the player to replace additional cards in their hand of cards after drawing the replacement cards in step (c) for each card in their hand of cards having the face value and/or suit identified in step (b);

(e) replacing a card in the player's hand of cards when the player exercises a first option granted in step (d), the card to be replaced being from one of the two ends of the line of cards as selected by the player;

(f) repeating steps (d) and (e) when the player exercises a first option and draws a replacement card having the unique indicia thereon; and (g) determining if the player's hand of cards is a winning hand of cards.

21. The computer readable medium containing computer executable instructions for playing a modified draw poker game in accordance with claim 20 wherein at least one card in the deck of cards is randomly dealt at the same time that the initial hand of cards is dealt and the face value and/or suit of the randomly dealt card(s) are the identified in step (b).

* * * * *